US012345003B2

(12) United States Patent
Giles et al.

(10) Patent No.: US 12,345,003 B2
(45) Date of Patent: Jul. 1, 2025

(54) AUTOMATIC SIDE BROOM STRIKE PATTERN POSITIONING SYSTEM FOR A STREET SWEEPING MACHINE

(71) Applicant: Schwarze Industries, Inc., Huntsville, AL (US)

(72) Inventors: Brian D. Giles, New Market, AL (US); Alston Roberson, Priceville, AL (US); Felix W. Crunk, III, Meridianville, AL (US); Sean E. Howley, Huntsville, AL (US)

(73) Assignee: Schwarze Industries LLC, Huntsville, AL (US)

( * ) Notice: Subject to any disclaimer, the term of this patent is extended or adjusted under 35 U.S.C. 154(b) by 457 days.

(21) Appl. No.: 17/736,884

(22) Filed: May 4, 2022

(65) Prior Publication Data

US 2022/0356661 A1 Nov. 10, 2022

Related U.S. Application Data

(60) Provisional application No. 63/183,875, filed on May 4, 2021.

(51) Int. Cl.
*E01H 1/05* (2006.01)

(52) U.S. Cl.
CPC ..... *E01H 1/053* (2013.01)

(58) Field of Classification Search
CPC ..... E01H 1/053
See application file for complete search history.

(56) References Cited

U.S. PATENT DOCUMENTS 1,407,180 A 2/1922 Todd
2,972,159 A 2/1961 Swanson et al.
(Continued)

FOREIGN PATENT DOCUMENTS

CA 3042127 A1 5/2018
CN 205475016 U 8/2016
(Continued)

OTHER PUBLICATIONS

The International Search Report and the Written Opinion of the International Searching Authority mailed Aug. 10, 2022 in corresponding PCT Patent App. No. PCT/US22/27710 (14 pages).
(Continued)

*Primary Examiner* — Rachid Bendidi
*Assistant Examiner* — Kirsten Jade M Santos
(74) *Attorney, Agent, or Firm* — Pizarro Allen PC

(57) ABSTRACT

A sweeper vehicle may have an automatic side broom strike pattern positioning system including a plurality of actuators (e.g., pneumatic, hydraulic, and/or powered leadscrew) and a plurality of sensors (e.g., inclinometers and position sensors). The strike pattern may be maintained at a desired position as the side broom moves to different positions in a range of movement between a fully extended position and a fully retracted position. The system may have an override feature by which a vehicle operator may interrupt the automatic side broom positioning to allow the vehicle operator to take direct control of one or more side brooms, including the broom deployment angle and broom pitch and roll to create desired strike patterns for the side brooms. Related methods are also described.

20 Claims, 16 Drawing Sheets

(56) References Cited

U.S. PATENT DOCUMENTS

| | | | |
|---|---|---|---|
| 3,186,021 | A | 6/1965 | Krier et al. |
| 3,886,623 | A | 6/1975 | Landesman et al. |
| 3,886,624 | A | 6/1975 | Landesman et al. |
| 4,490,874 | A | 1/1985 | Duncan |
| 4,571,771 | A | 2/1986 | Worwa |
| 4,754,521 | A | 7/1988 | Zoni |
| 4,831,684 | A | 5/1989 | Duncan |
| 6,041,471 | A | 3/2000 | Charky et al. |
| 6,195,837 | B1 | 3/2001 | Vanderlinden |
| 6,263,540 | B1 | 7/2001 | Vanderlinden |
| 8,904,653 | B1 | 12/2014 | Miaskiewicz |
| 9,353,492 | B1 | 5/2016 | Stell et al. |
| 9,783,942 | B1 | 10/2017 | Stell et al. |
| 10,711,416 | B2 | 7/2020 | Glubrecht et al. |
| 2004/0045581 | A1 | 3/2004 | Boomgaarden et al. |
| 2005/0060834 | A1 | 3/2005 | Strauser |
| 2007/0124892 | A1 | 6/2007 | Adair et al. |
| 2009/0013496 | A1 | 1/2009 | Byczynski |
| 2010/0011523 | A1* | 1/2010 | James ..... E01H 1/053 |
| 2012/0192377 | A1 | 8/2012 | Stell |
| 2014/0101874 | A1 | 4/2014 | Du Maire et al. |
| 2018/0298573 | A1 | 10/2018 | Glubrecht et al. |
| 2020/0068844 | A1 | 3/2020 | Ter Borgh |

FOREIGN PATENT DOCUMENTS

| | | | | |
|---|---|---|---|---|
| DE | 4128988 | A1 | 3/1993 | |
| EP | 1061180 | A1 | 12/2000 | |
| GB | 1112147 | A | 5/1968 | |
| GB | 2246381 | A | 1/1992 | |
| JP | 61-075110 | | 4/1986 | |
| JP | H0579021 | A * | 3/1993 | ..... E01H 1/02 |
| JP | H07138924 | | 5/1995 | |
| JP | 2002021032 | A | 1/2002 | |
| JP | 4193085 | B2 | 12/2008 | |
| JP | 2014-523893 | A | 9/2014 | |
| KR | 100779568 | | 11/2007 | |
| KR | 10-0917591 | B1 | 9/2009 | |
| KR | 20100086614 | A | 8/2010 | |
| KR | 10-1103139 | B1 | 1/2012 | |
| KR | 10-1718125 | B1 | 3/2017 | |
| WO | 2012003727 | A1 | 1/2012 | |
| WO | 2012088869 | | 7/2012 | |
| WO | 2012/145694 | A1 | 10/2012 | |
| WO | 2018186532 | A1 | 11/2018 | |

OTHER PUBLICATIONS

Wayne Engineering Front Sweeper Broom Attachment, dated Oct. 14, 2011.

Chengli Special Automobile Co., Ltd. (CLW 5071TSL4 Road sweeper with side brooms), dated Jun. 3, 2015.

Beam—The specialist range S9000-S14000, dated 2009.

* cited by examiner

FIG. 1
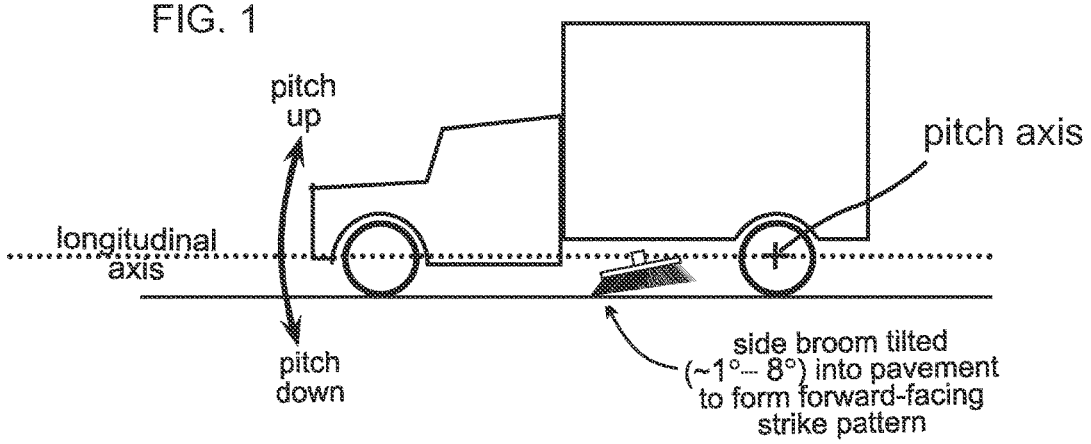
FIG. 2
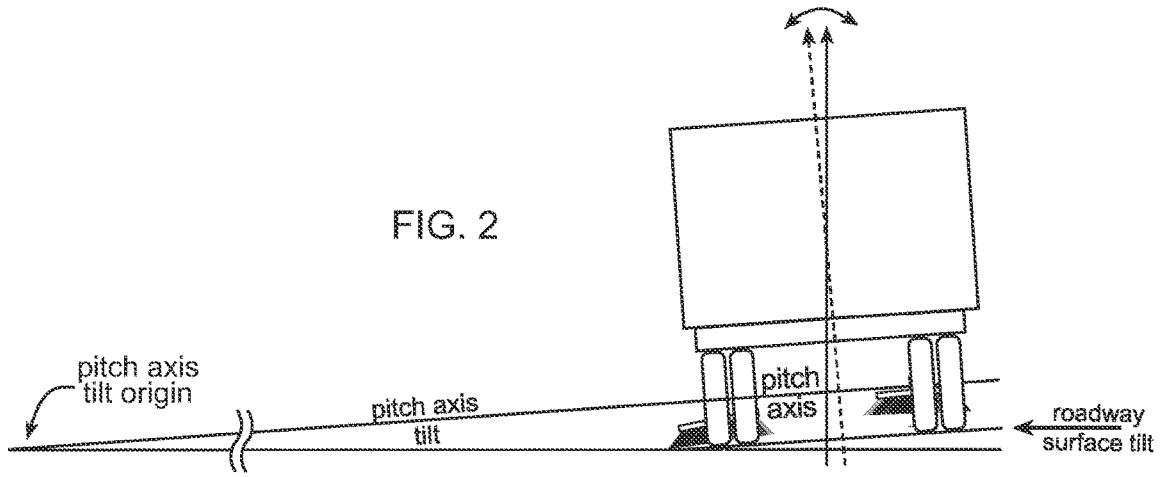
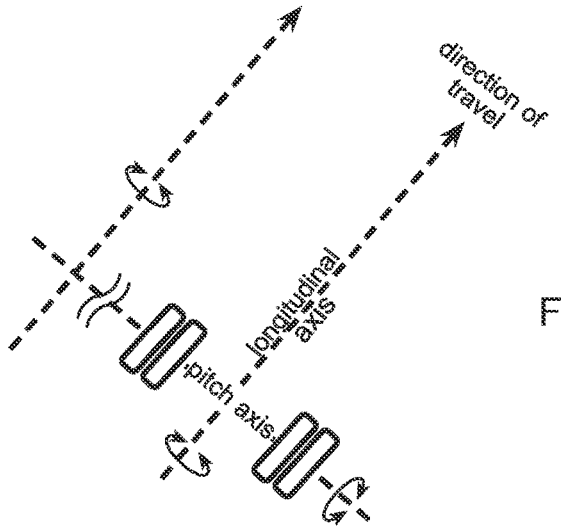
FIG. 3

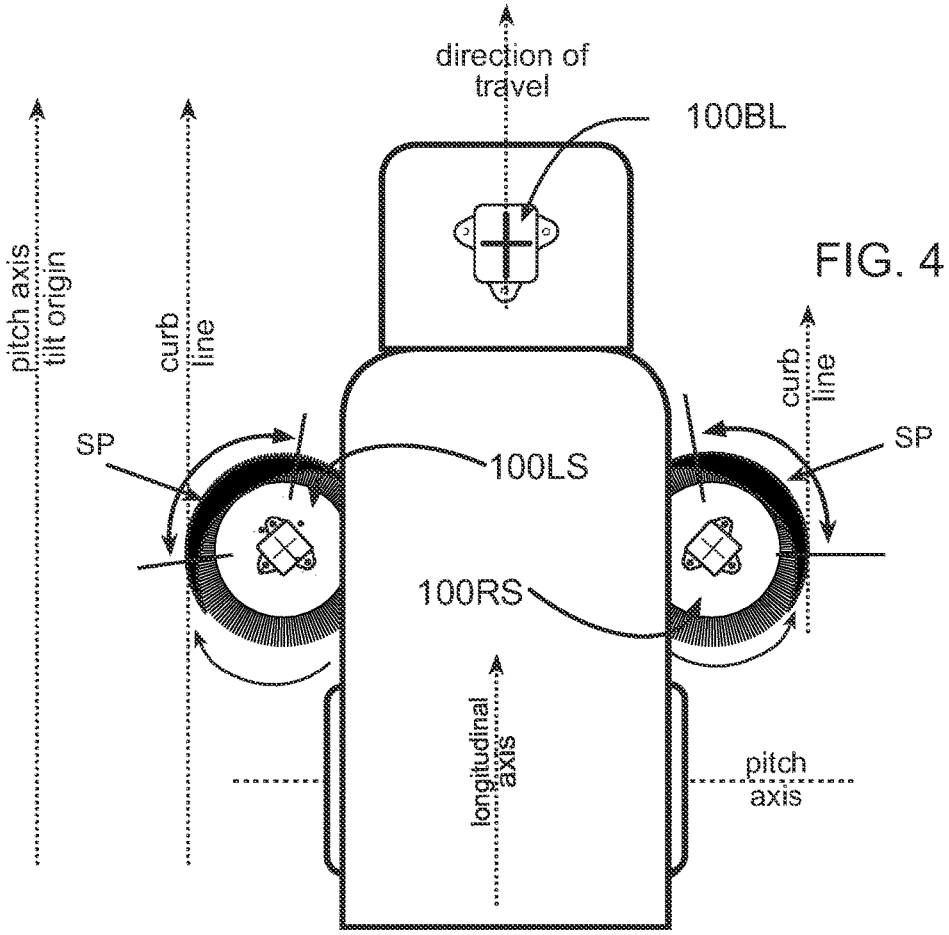
FIG. 4
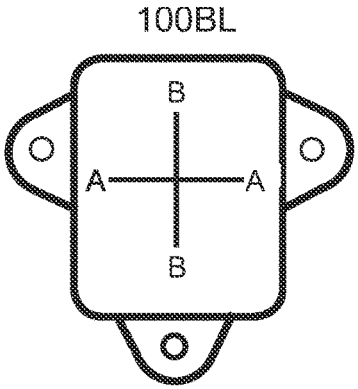
FIG. 4.1
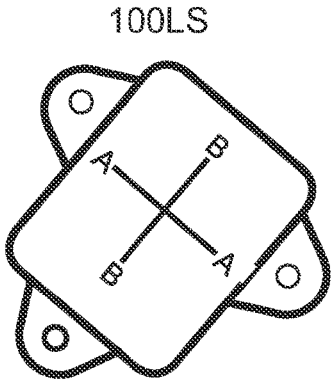
FIG. 4.2
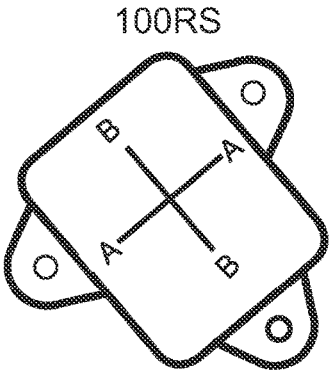
FIG. 4.3

FIG. 4.4
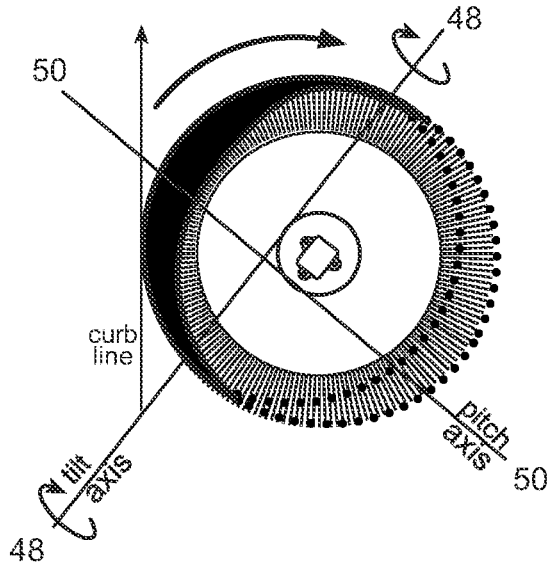
FIG. 4.5
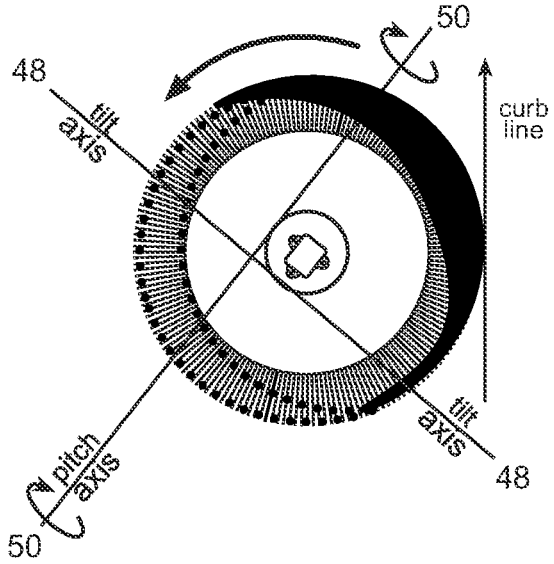
FIG. 4.6
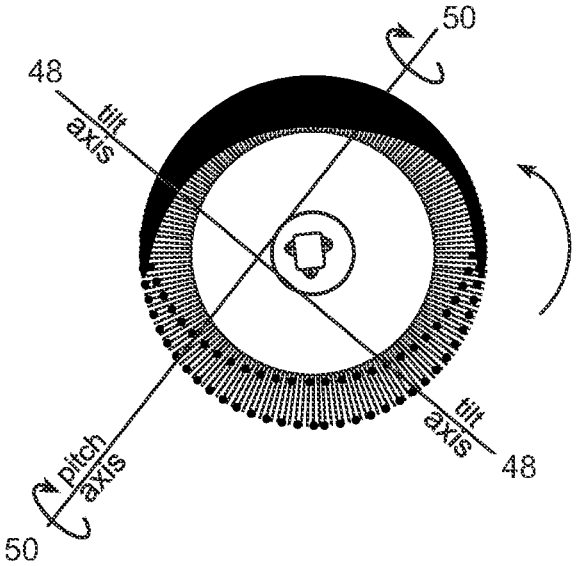

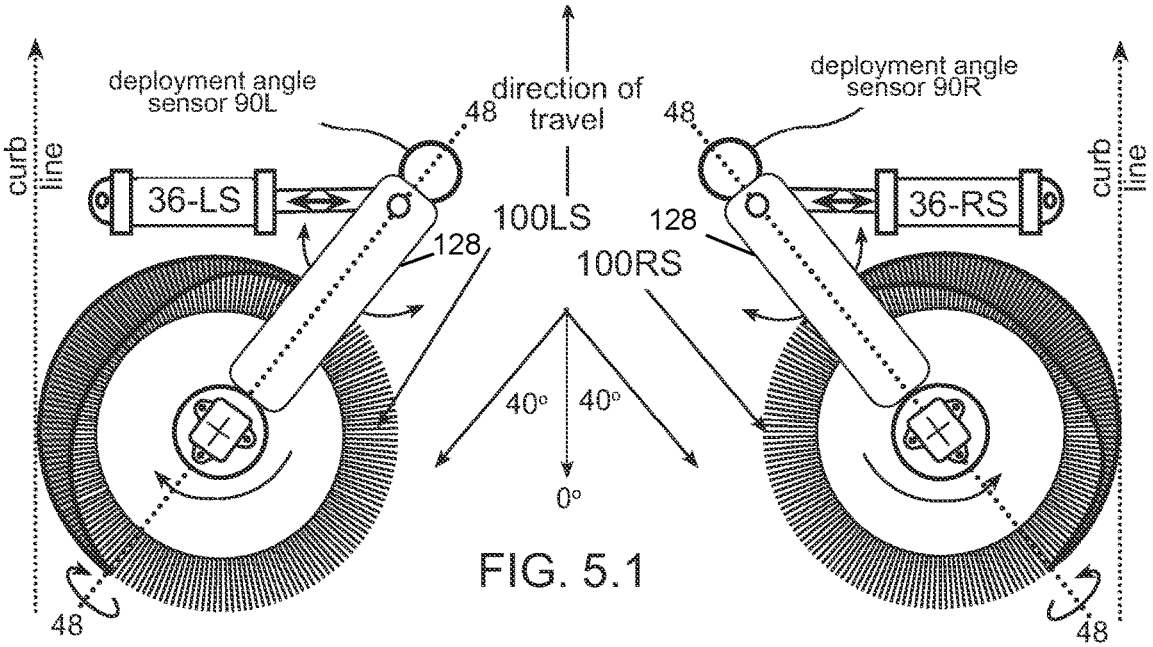
FIG. 5.1
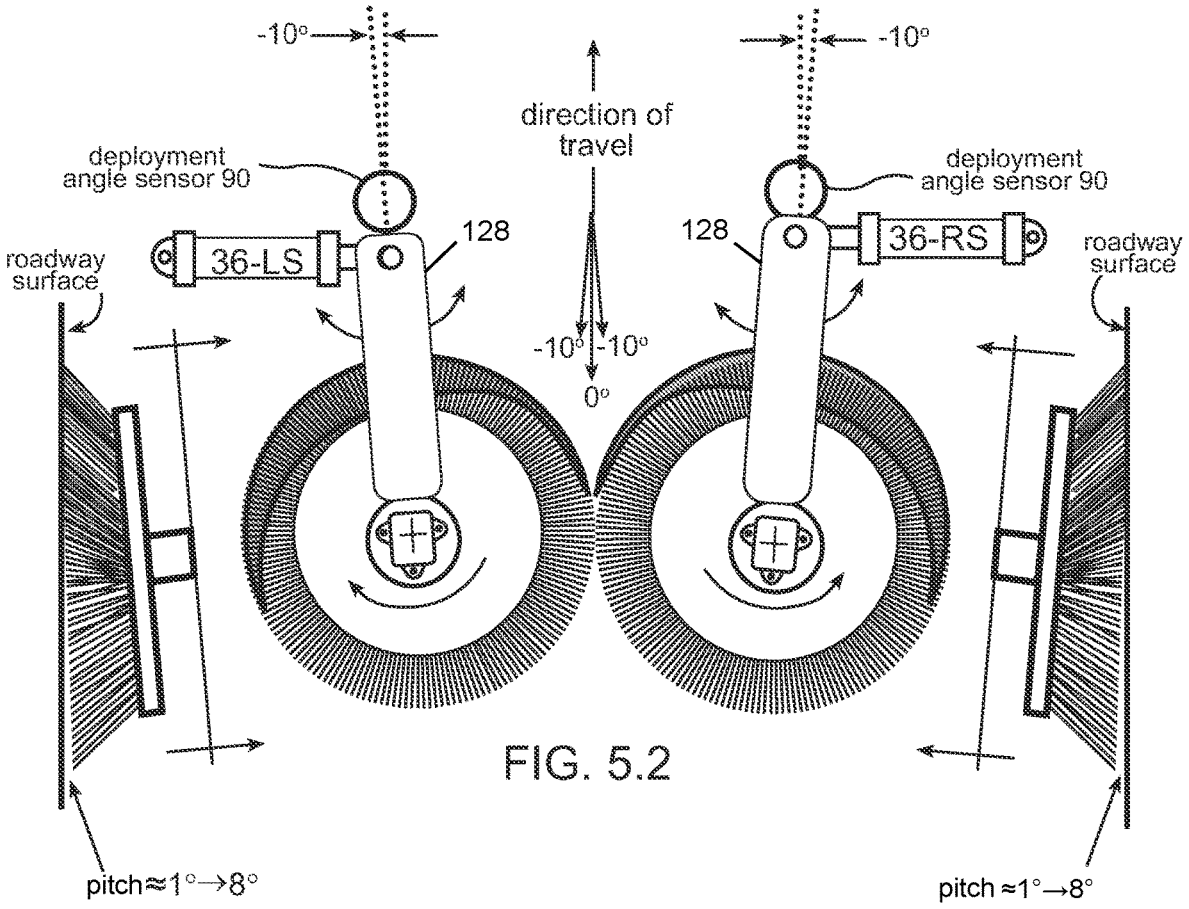
FIG. 5.2

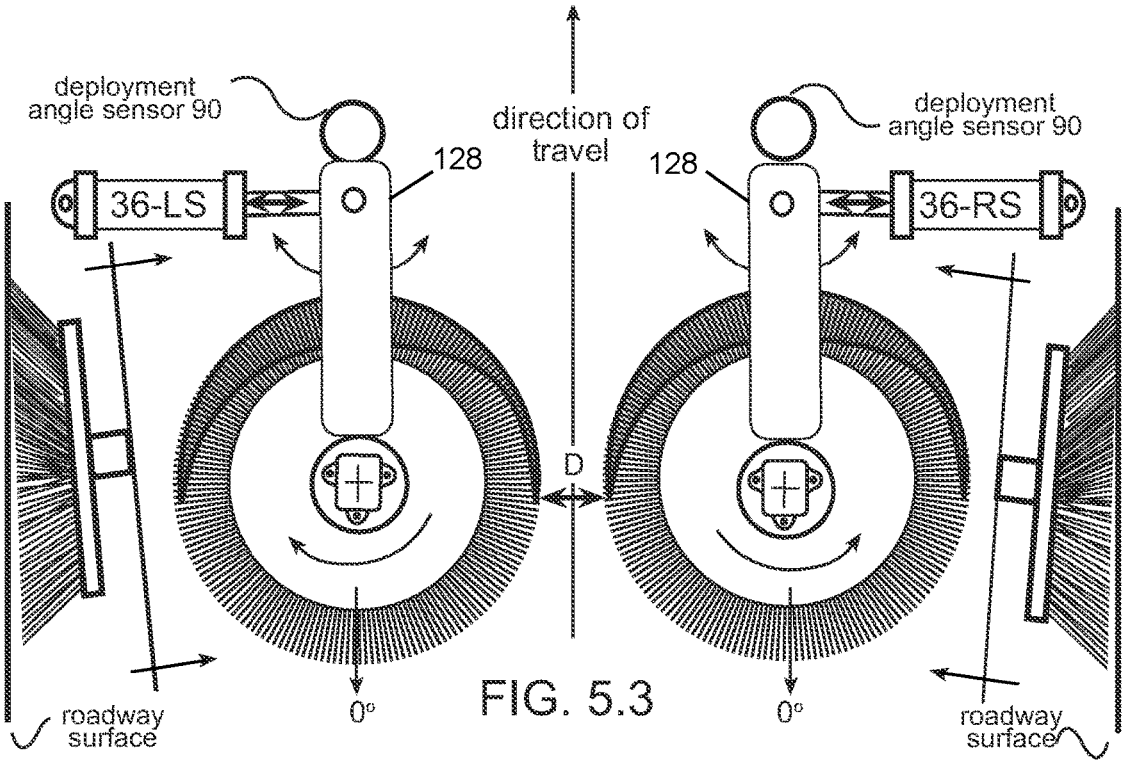
FIG. 5.3
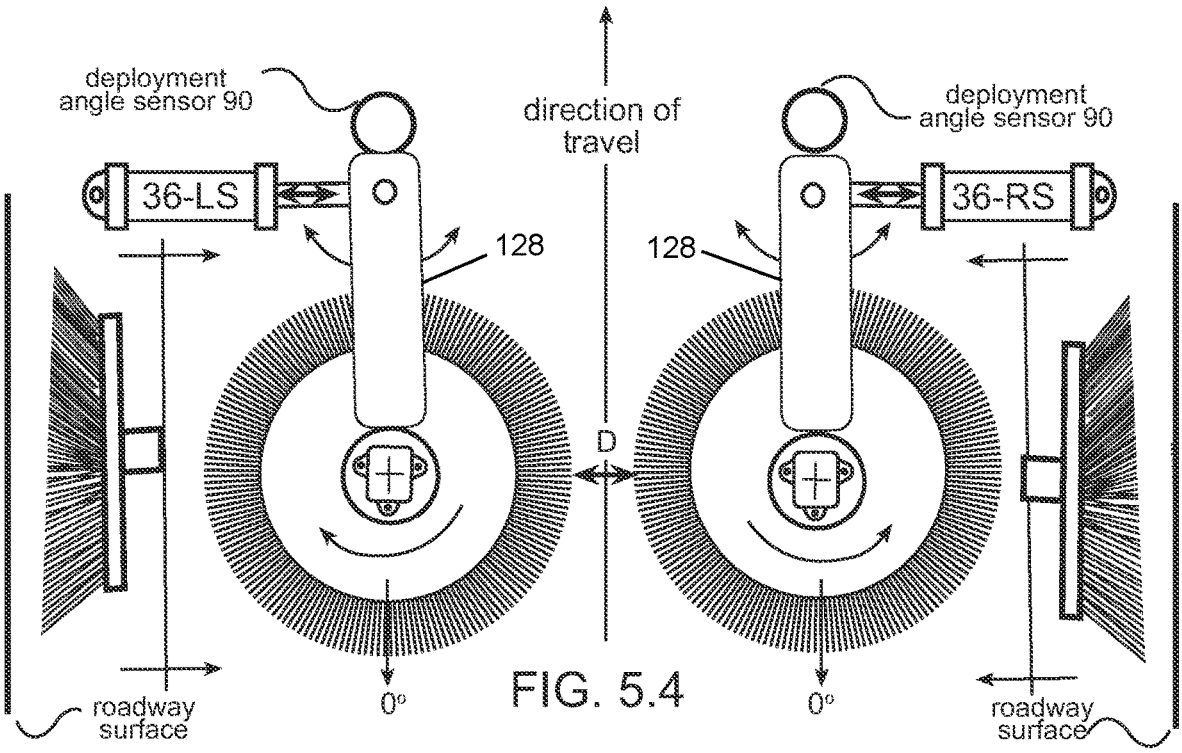
FIG. 5.4

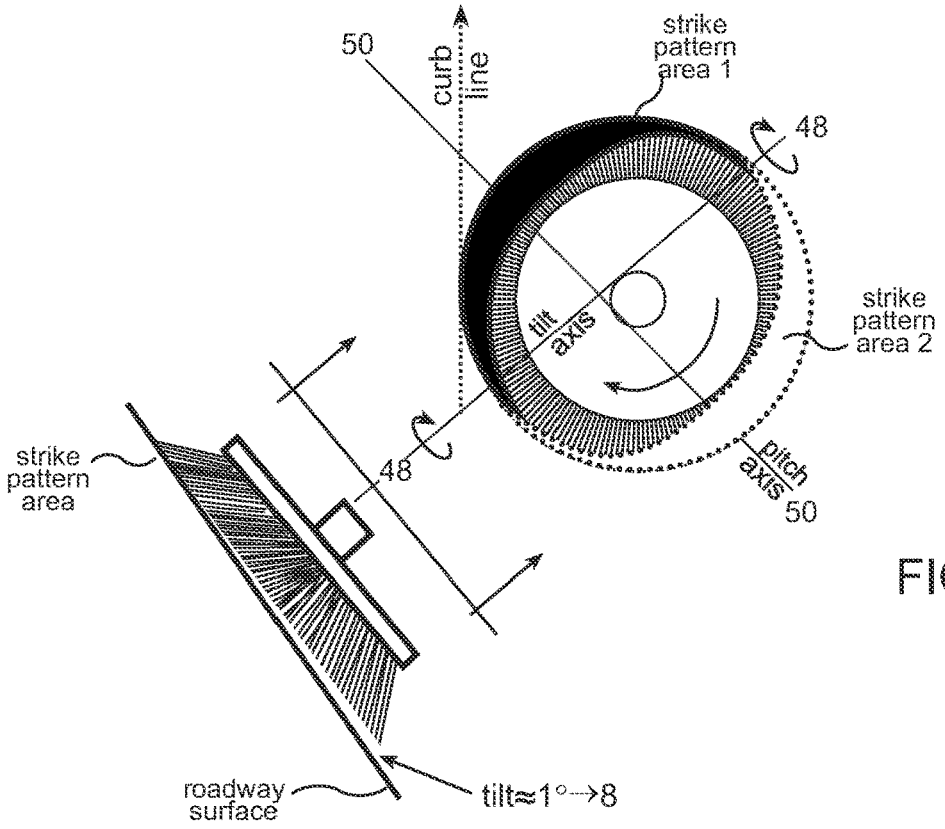
FIG. 5.5
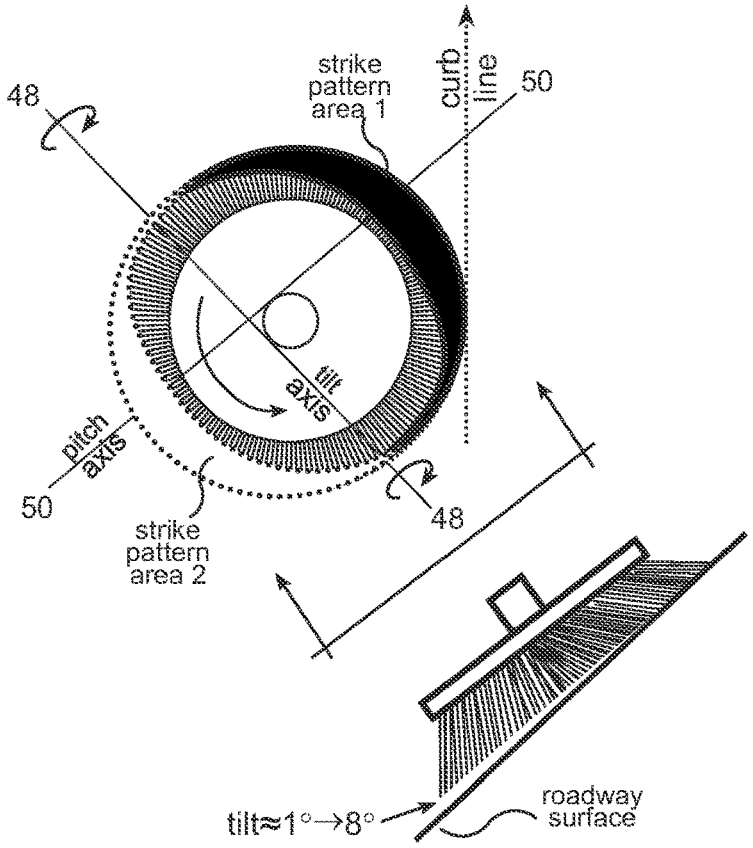
FIG. 5.6

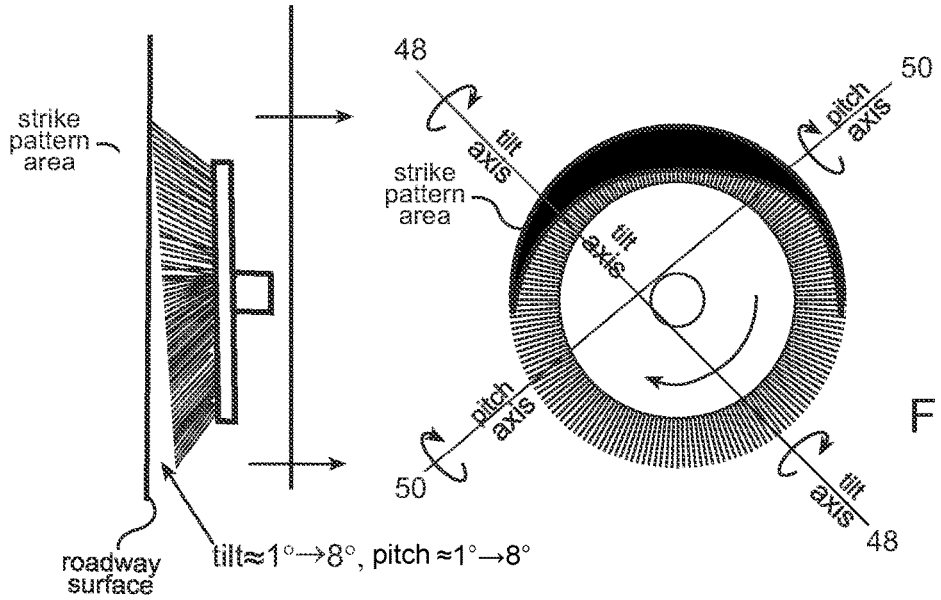
FIG. 5.7
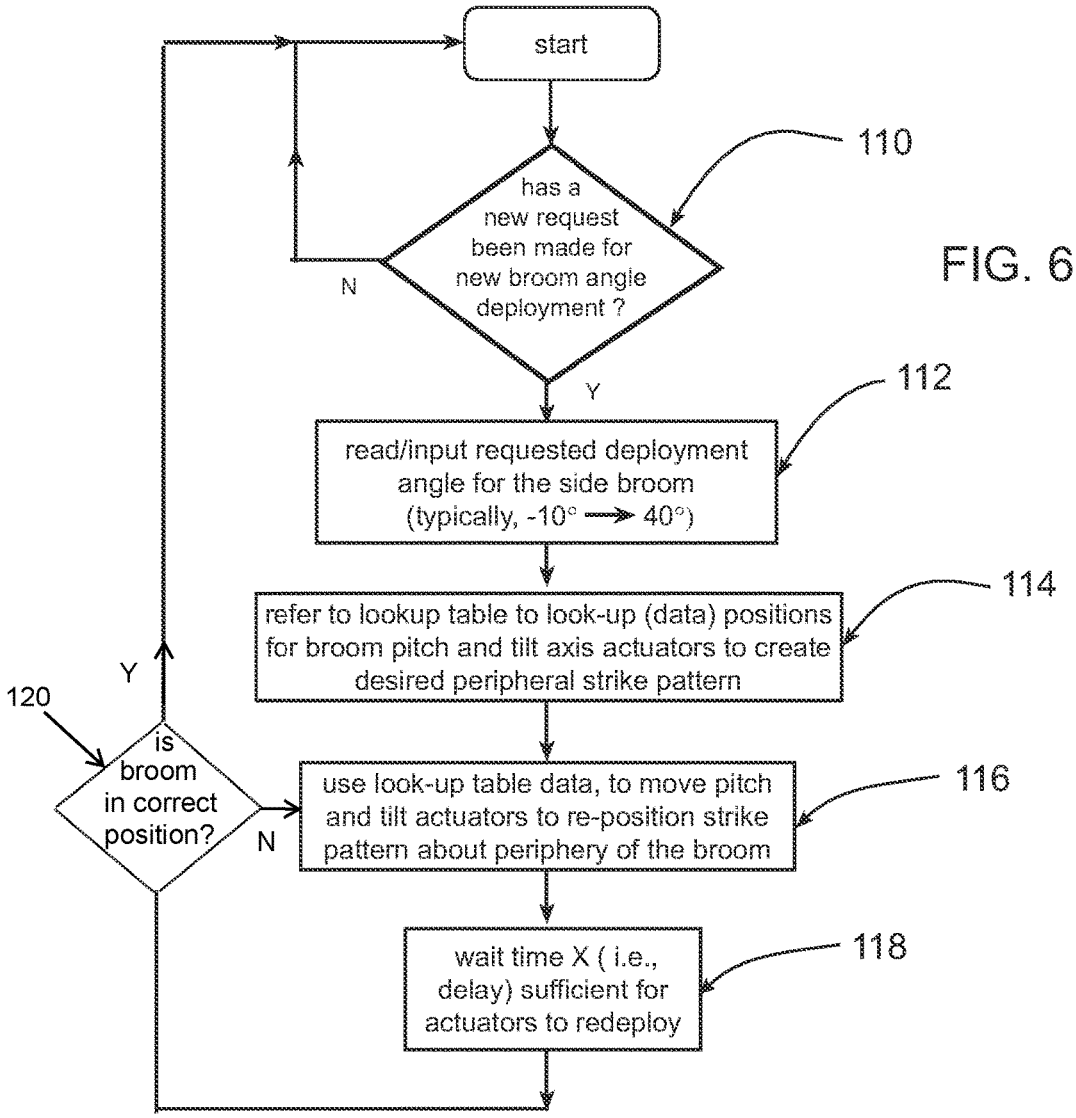
FIG. 6

FIG. 7
| NEW/UPDATED BROOM DEPLOYMENT ANGLE | SET ANGULAR DEPLOYMENT ACTUATOR TO NEW/ UPDATED VALUE & VERIFY (v) | SET TILT ACTUATOR TO SPECIFY STRIKE PATTERN | SET PITCH ACTUATOR TO SPECIFY STRIKE PATTERN |
|---|---|---|---|
| 5° | v | % | % |
| 10° | v | % | % |
| 15° | v | % | % |
| 25° | v | % | % |
| 30° | v | % | % |
| 35° | v | % | % |
| 40° | v | % | % |
FIG. 8
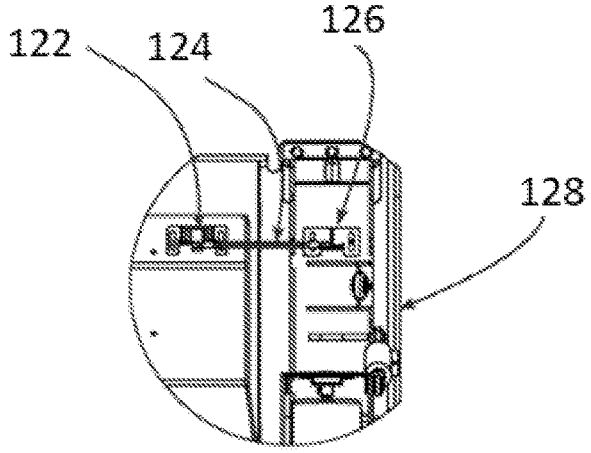
FIG. 9
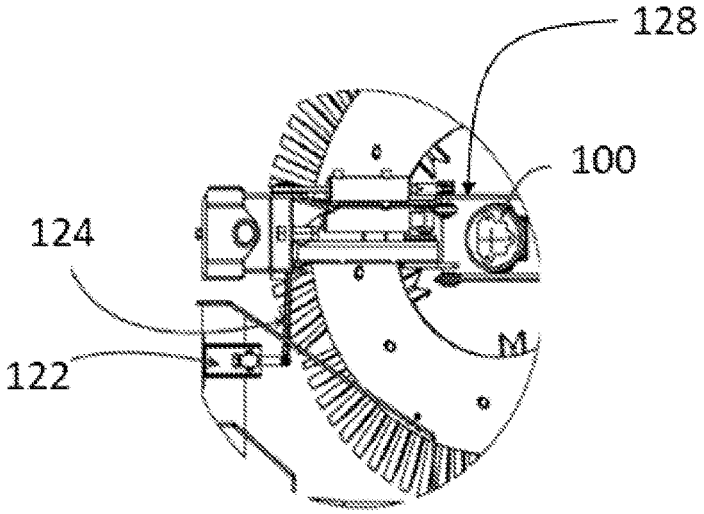

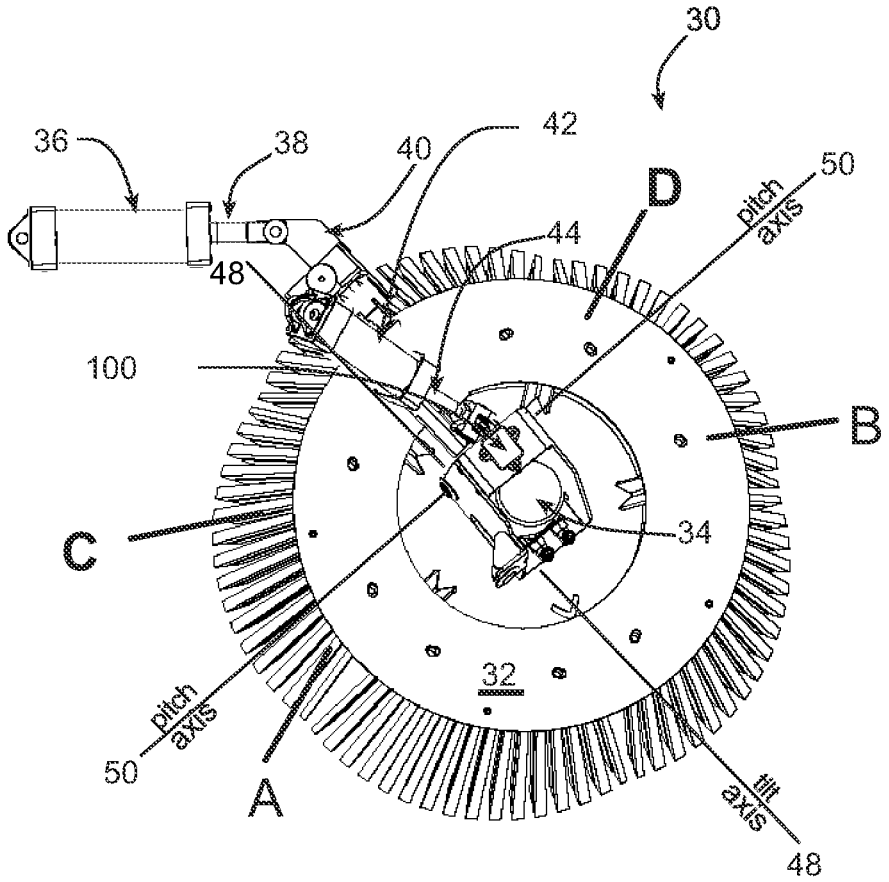
FIG. 10
FIG. 11
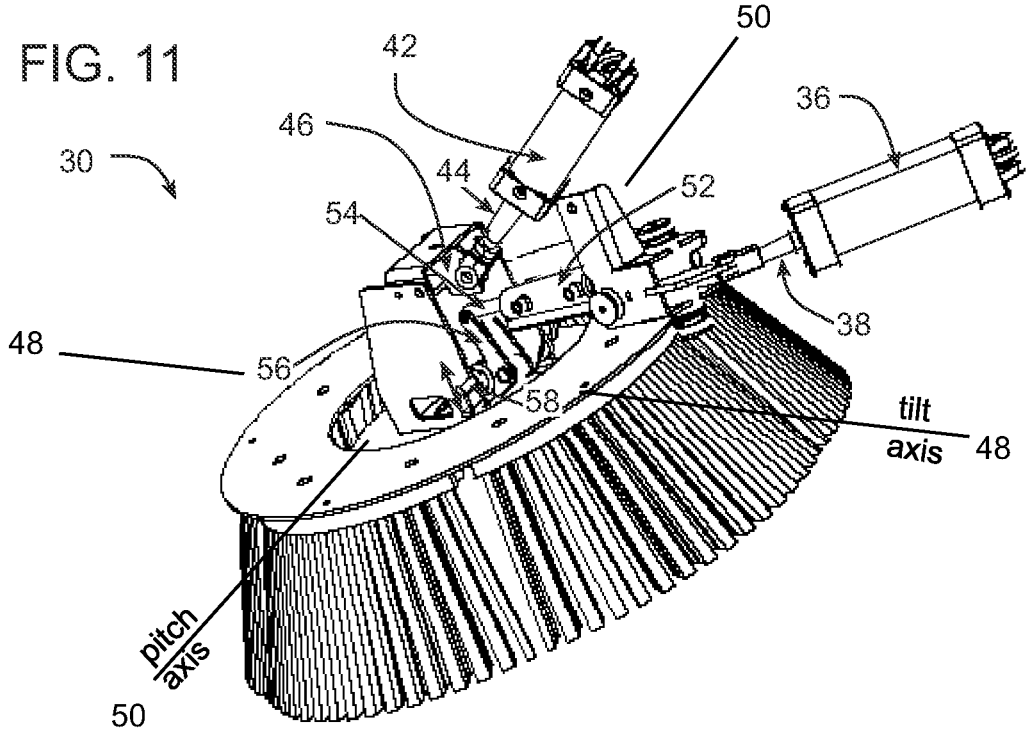

FIG. 17
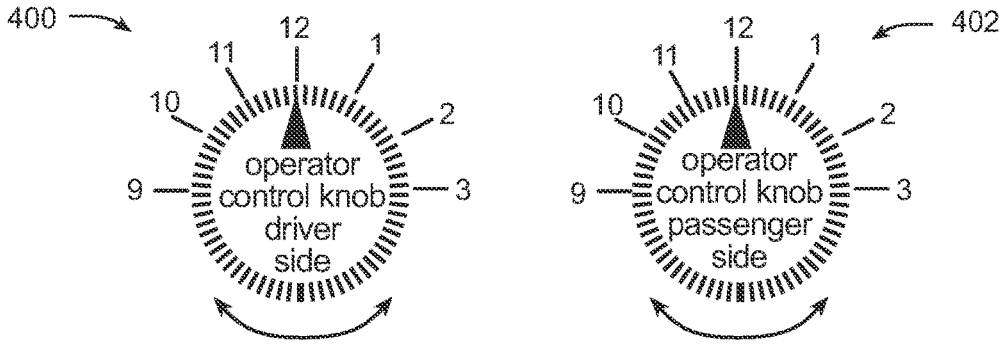
FIG. 17.1
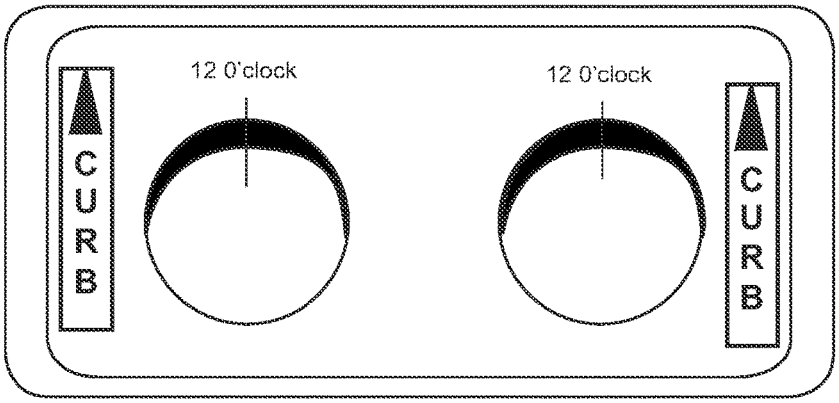
FIG. 18
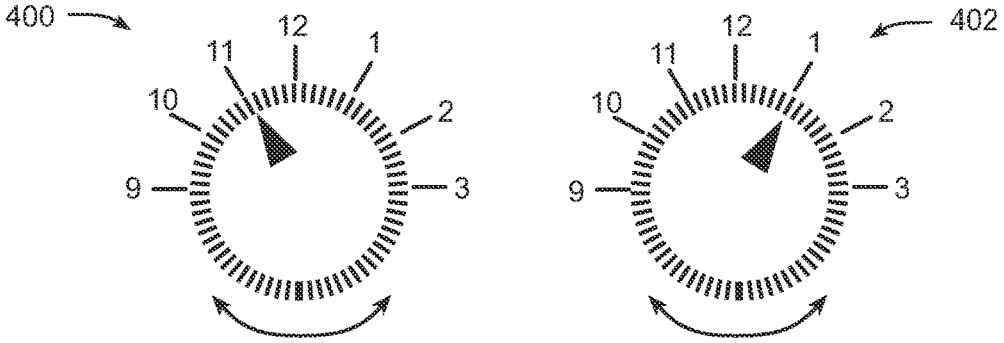
FIG. 18.1
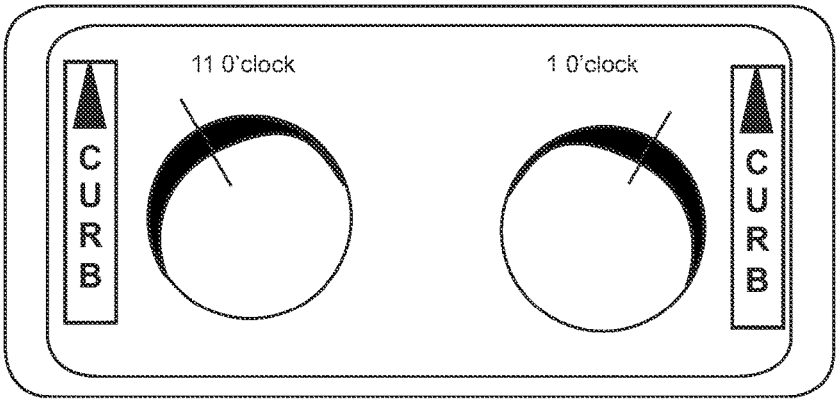

FIG. 19
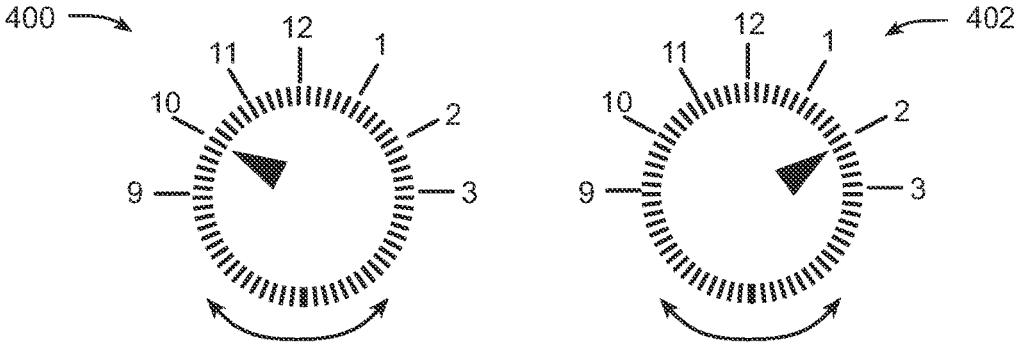
FIG. 19.1
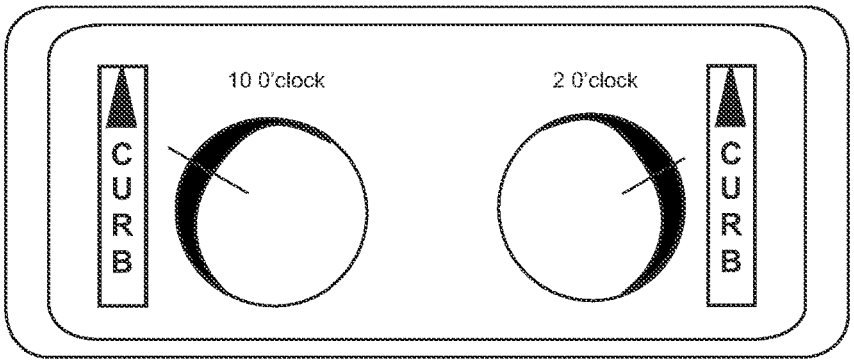
FIG. 20
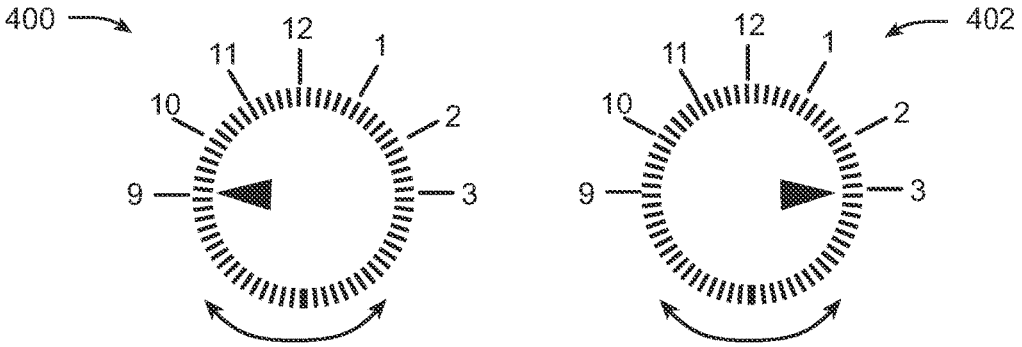
FIG. 20.1
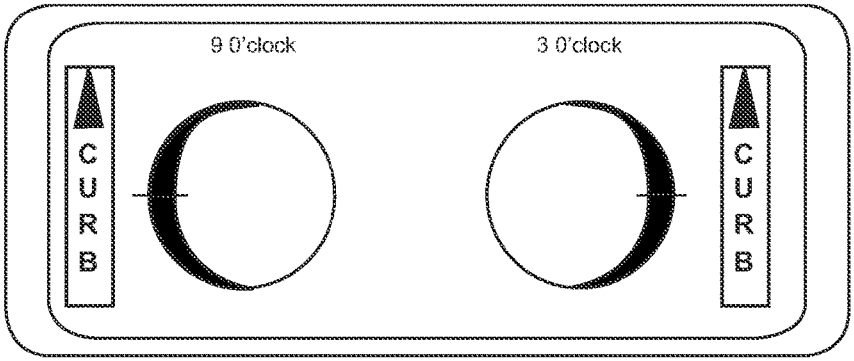

AUTOMATIC SIDE BROOM STRIKE PATTERN POSITIONING SYSTEM FOR A STREET SWEEPING MACHINE

CROSS REFERENCE TO RELATED APPLICATIONS

This application claims priority to U.S. Provisional Patent Application No. 63/183,875 filed May 4, 2021, the disclosure of which is incorporated herein by reference.

BACKGROUND

This section is intended to provide a background or context to the invention that is recited in the claims. The description herein may include concepts that could be pursued but are not necessarily ones that have been previously conceived or pursued. Therefore, unless otherwise indicated herein, what is described in this section is not prior art to the description and claims in this application and is not admitted to be prior art by inclusion in this section.

Various types of vehicles have been developed to sweep or vacuum debris from pavements, roadways, and streets. In general, these vehicles can be classified as mechanical broom sweepers, regenerative air sweepers, vacuum sweepers, and, in some cases, combinational variants thereof.

Mechanical broom sweepers use a motor-driven broom or brooms to mechanically sweep paper, plastic, litter, trash, vegetation (leaves, twigs, grass clippings, etc.), asphalt debris, concrete debris, and larger sand or gravel particles toward and onto a conveyor for transport into a debris collection hopper.

Regenerative air sweepers use a motor-driven fan to create a high-velocity recirculating airflow to entrain dust, particulates, and other debris from the pavement or street surface. The recirculating airflow is passed through a debris container or hopper that includes various types of partitions, screens, and/or baffles that are designed to slow the airflow and cause the entrained debris to collect in the debris hopper.

Vacuum sweeper vehicles use a motor-driven fan to develop a sub-atmospheric pressure within the vehicle airflow pathway(s) so that ambient air at atmospheric pressure enters a suction-inlet or suction-inlets to create a suction effect to entrain debris into the airflow. The debris-entrained airflow is generally delivered to the debris-collecting hopper where the debris is separated from the airflow with the airflow being exhausted from the sweeper vehicle.

Typically, one or more side brooms (also known as gutter brooms) are each carried on a respective pivotally mounted arm connected to both lateral sides of the sweeper vehicle (e.g., connected to the truck frame-rails). In their extended positions, each side broom is lowered to the to-be-swept surface and the side broom is powered to rotate so as to brush debris into the path of an intake hood (also known as a pick-up head). The side brooms are mounted on swing arms so that each broom can be moved to a raised "stowed" position for travel along a roadway in which the broom bristles are not in contact with the roadway or street surface.

Contemporary street/roadway sweeping vehicles have evolved into sweeping configurations in which at least one of the side brooms is pivoted from its stowed position to an extended position from the side of the sweeper vehicle (oftentimes, about 40°, depending upon the manufacturer). The extended side broom is rotated (typically via a hydraulic motor) as the vehicle is driven along a curb so as to sweep any debris into the path of a vehicle air intake hood.

In order to further increase the sweeping efficiency of a side broom, the side broom is provided with one or more actuators (pneumatic, hydraulic, and/or electrical motor-driven lead screws), usually under the control of the vehicle operator, that forcibly "depresses" a selected portion of the periphery of the side broom to aggressively push the bristle ends into the surface being swept to "dig into" and remove "packed" debris and/or adhered debris from the gutter area and push the debris into the path of a pick-up air inlet. As used herein, the phrase "strike pattern" or "contact patch" refers to that portion of the peripheral bristles that more aggressively engages the surface being swept, in part, by being pushed into the surface being swept.

Brooms are often used to move debris in the direction of a suction inlet to improve sweeping efficiency. For example, a cylindrical tube broom may be aligned in a lateral side-to-side alignment (or at a selected angle relative to the longitudinal axis of the vehicle) in relationship to the direction of travel of the vehicle to move debris toward a suction-inlet positioned closer to one end of the broom.

While tube brooms may be effective where the road surfaces are flat, many streets and road surfaces have an irregular profile. For example, many road surfaces are intentionally crowned at the center of the roadway to facilitate storm water drainage. Additionally, roadway surfaces may have unintentional spaced-apart depressions caused by the front and rear tires of heavy vehicles. In these situations, a tube broom may efficiently sweep the flat portions of the road surface but, in some cases, may be less effective or inefficient for sweeping the depressed areas of the roadway. It is also common for the tube broom to wear unevenly and often become tapered at one or both ends, a condition known as "coning."

SUMMARY

A system for the control of a strike pattern of one or more side broom assemblies mounted to a roadway/street sweeper vehicle in which the lateral extent of each side broom can be individually controlled from a fully extended position to a fully retracted position and in which a peripheral portion (the "strike pattern" or "contact patch") of each side broom can be individually controlled to increase the force with which a peripheral portion of the bristle ends aggressively engage the surface being swept to improve sweeping efficiency. Positional control of the strike pattern is independently achieved for each side broom by broom actuators that rotate the side broom about a tilt axis and/or a pitch axis to move the "strike" pattern about the periphery of the side broom for sweeping debris from the roadway surface as the vehicle is moving along a direction of travel, for example, as the side broom brushes along a curb to brush debris from the gutter area. The "strike" pattern position can be maintained for each side broom without regard to the angular extension of the side broom; if the extension angle changes, the control system can reposition the strike zone as necessary. Each strike pattern is formed by forcing a peripheral portion of each side broom into the pavement or roadway at a selected angle (usually between approximately≈1°→8° or so degrees) to push the broom bristles into an aggressive engagement with the pavement or roadway surface to increase sweeping effectiveness. The "tilt" movement is sometimes referred to herein as "roll."

The automatic control of a side broom can be overridden by the vehicle operator to provide a plurality of operator-selectable manual strike patterns in response to sweeping conditions.

In a representative embodiment, each side broom is independently movable or, if desired, movable in unison, between a "stowed" position (typically partially or entirely beneath the vehicle) and a fully extended position (usually about 40° or so from the side of the sweeper vehicle) or any position therebetween. Each side broom has actuators (such as, e.g., pneumatic, hydraulic, or a powered lead screw) for tilting a side broom about a tilt axis and/or a pitch axis in a gutter sweeping mode to sweep debris from the gutter area where the curbstone and the roadway surface meet. For gutter sweeping, the tilt and pitch actuators are controlled to locate the strike pattern for efficient sweeping.

When not in the gutter sweeping mode (for example, when sweeping a parking lot or the different levels of a parking garage), the broom or brooms can be manipulated so that a strike pattern is controlled so as to be in a generally forward-facing direction consistent with the direction of travel of the sweeper vehicle regardless of the angular position of the broom between its "stowed" and its fully extended position. Thus, a broom can be extended to one or more intermediate positions between its stowed position and its fully extended position while the automated broom control system maintains a desired generally forward-facing "strike" pattern.

An angular displacement sensor, such as digital sensor or an analog device and a connected analog-to-digital converter, directly or indirectly associated with each side broom assemblage, measures or otherwise detects the respective angular extension (e.g., from the stowed position or, conversely, from the fully extended position) for each broom. The angular extension is used, for example, to query a look-up table for determining the tilt and pitch of a side broom to achieve a preferred "strike" pattern for the direction of travel with the system manipulating one or more actuators (pneumatic, hydraulic, or electrically powered lead screw) to change the tilt and or pitch of the side boom so as to increase the force applied by the ends of the broom bristles in a selected peripheral "strike" zone.

In some embodiments, a multi-axis inclinometer is mounted to the vehicle, for example, directly or indirectly, to the vehicle frame to measure the vehicle tilt about its front-to-back longitudinal axis and to measure vehicle pitch about a side-to-side pitch axis when sweeping on a roadway or street.

In some embodiments, multi-axis inclinometers are also affixed to each broom motor support assembly (i.e., the non-rotating components) such that the broom-mounted multi-axis inclinometer provides an output for broom angular position about at least two axes including a side broom tilt axis (i.e., broom "tilt") and a side broom pitch axis (i.e., broom "pitch").

If desired, discrete individually mounted inclinometers can be used rather than a multi-axis inclinometer.

A stored-program controlled processor (with appropriate memory, display, and command input) accepts the inputs of the various inclinometers and outputs appropriate broom tilt and/or pitch values for positioning a "strike" pattern for the side broom when that side broom is in a forward-sweeping mode or a gutter-sweeping mode.

In some embodiments, an empirically determined look-up table is provided for each side broom angular position between a stowed position (partially or fully beneath the body of the sweeper vehicle) and a fully extended position. If desired, the angular positions can be in, for example, 5° or 10° increments. The look-up table provides positioning information for a first actuator (pneumatic, hydraulic, or electrically driven lead screw) and for a second actuator for maintaining the position of a strike pattern about the periphery of the side broom. The automatic broom positioning system preferably operates continuously to provide correction values for each side broom to maintain the position of the strike pattern in the desired position as a side broom transitions to different positions with respect to the sweeper vehicle, e.g., as the sweeper is moving in a forward direction of travel.

The system is provided with a manual override feature by which the vehicle operator can override the system for automatic control to create a plurality of manually inputted positions by which the "strike" pattern can be moved to different peripheral positions about the side broom, depending upon the sweeping needs.

In some embodiments, a system for automatic positioning of a strike pattern of one or more side brooms mounted to a sweeper vehicle on a roadway is provided, the sweeper vehicle having a chassis and a longitudinal axis, each side broom movable between a fully extended position and a stowed position. The system may include: a first baseline inclinometer attached, directly or indirectly, to the vehicle chassis and having a sensitive axis aligned along a front-to-back axis of the sweeper vehicle for measuring vehicle tilt about the front-to-back axis; a second baseline inclinometer attached, directly or indirectly, to the vehicle chassis and having a sensitive axis aligned along a side-to-side axis of the sweeper vehicle for measuring vehicle pitch about the side-to-side axis; at least one side broom mounted to the sweeper vehicle and including bristles; at least one actuator configured for moving the at least one side broom between an extended position and a stowed position; an angular deployment sensor configured for sensing an angular deployment position of the at least one side broom relative to the longitudinal axis of the sweeper vehicle; a broom tilt inclinometer attached to the at least one side broom for measuring a broom tilt angle about a broom tilt axis for the at least one side broom; a broom pitch inclinometer attached to the at least one side broom for measuring a broom pitch angle about a broom pitch axis for the at least one side broom; a broom tilt actuator configured for adjusting the broom tilt angle; a broom pitch actuator configured for adjusting the broom pitch angle; and a controller in communication with the inclinometers and the actuators, the controller configured for positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

In some embodiments, the controller may be configured to maintain the selected strike pattern regardless of the angular deployment position.

In some embodiments, the controller may include an override mode to enable a vehicle operator to control the strike pattern.

In some embodiments, the first and second baseline inclinometers may comprise a multi-axis inclinometer.

In some embodiments, the broom tilt inclinometer and the broom pitch inclinometer may comprise a multi-axis inclinometer.

In some embodiments, an orientation of the strike pattern may be selectable with respect to the longitudinal axis of the sweeper vehicle.

In some embodiments, the system may further include a control knob configured for enabling a vehicle operator to select the orientation of the strike pattern in reference to a clock position, wherein a 12 o'clock position corresponds to a generally forward-facing direction consistent with a direction of travel of the sweeper vehicle.

In some embodiments, the at least one side broom may include a left side broom and a right side broom, and the strike patterns of the left side broom and the right side broom may be independently selectable.

In some embodiments, the strike patterns of the left side broom and the right side broom may be selectable in reference to a left curb and a right curb, respectively.

In some embodiments, a method of controlling a strike pattern of at least one side broom mounted to a sweeper vehicle on a roadway is provided, the sweeper vehicle having a chassis and a longitudinal axis, each side broom including bristles and movable between a fully extended position and a stowed position. The method may include: measuring a vehicle tilt about a front-to-back axis of the sweeper vehicle; measuring a vehicle pitch about a side-to-side axis of the sweeper vehicle; sensing an angular deployment position of the at least one side broom relative to the longitudinal axis of the sweeper vehicle; measuring a broom tilt angle about a broom tilt axis for the at least one side broom; measuring a broom pitch angle about a broom pitch axis for the at least one side broom; and positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

In some embodiments, the vehicle tilt, the vehicle pitch, the broom tilt angle, and the broom pitch angle may be measured using a plurality of inclinometers.

In some embodiments, the method may further include using a lookup table to determine settings for a pitch axis actuator and a tilt axis actuator for the at least one side broom.

In some embodiments, the settings for the pitch axis actuator and the tilt axis actuator may be determined based on the angular deployment position.

In some embodiments, the method may further include maintaining the selected strike pattern as the angular deployment position changes.

In some embodiments, the positioning may be carried out by a controller including an override mode that enables a vehicle operator to control the strike pattern.

In some embodiments, a sweeper vehicle having a chassis and a longitudinal axis may include: a first baseline inclinometer attached, directly or indirectly, to the vehicle chassis and having a sensitive axis aligned along a front-to-back axis of the sweeper vehicle for measuring vehicle tilt about the front-to-back axis; a second baseline inclinometer attached, directly or indirectly, to the vehicle chassis and having a sensitive axis aligned along a side-to-side axis of the sweeper vehicle for measuring vehicle pitch about the side-to-side axis; at least one side broom mounted to the sweeper vehicle and comprising bristles; at least one actuator configured for moving the at least one side broom between an extended position and a stowed position; an angular deployment sensor configured for sensing an angular deployment position of the at least one side broom relative to the longitudinal axis of the sweeper vehicle; a broom tilt inclinometer attached to the at least one side broom for measuring a broom tilt angle about a broom tilt axis for the at least one side broom; a broom pitch inclinometer attached to the at least one side broom for measuring a broom pitch angle about a broom pitch axis for the at least one side broom; a broom tilt actuator configured for adjusting the broom tilt angle; a broom pitch actuator configured for adjusting the broom pitch angle; and a controller in communication with the inclinometers and the actuators, the controller configured for positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

In some embodiments, the controller may be configured to maintain the selected strike pattern as the angular deployment position changes.

In some embodiments, the controller may include an override mode to enable a vehicle operator to control the strike pattern.

In some embodiments, the sweeper vehicle may further include a control knob configured for enabling a vehicle operator to select an orientation of the strike pattern in reference to a clock position, wherein a 12 o'clock position corresponds to a generally forward-facing direction consistent with a direction of travel of the sweeper vehicle.

In some embodiments, the at least one side broom may include a left side broom and a right side broom, wherein the strike patterns of the left side broom and the right side broom are independently selectable.

BRIEF DESCRIPTION OF THE DRAWINGS

FIG. 1 is a left side elevational view of a sweeper vehicle, in schematic form, showing a pitch axis aligned with or coincident with the rear axle of the vehicle with a double arrow indicating possible pitch up and pitch down instances as the sweeper vehicle travels in a forward direction.

FIG. 2 is a rear elevational view of the sweeper vehicle of FIG. 1 traveling on a tilted roadway, such as a "crowned" roadway, with the pitch axis extending from the vehicle's rear axle and intersecting with a horizontal line at an origin.

FIG. 3 is a schematic diagram that summarizes the various axes presented in FIGS. 1 and 2.

FIG. 4 is a schematic plan view of the sweeper vehicle illustrated in FIGS. 1 and 2 showing a multi-axis inclinometer mounted in the area of the crew cabin and showing the side brooms in their extended positions, with each side broom having a multi-axis inclinometer attached thereto, wherein a waxing moon graphic illustrates the approximate size, shape, and orientation of the strike pattern of each side broom.

FIG. 4.1 is an enlarged schematic plan view of a baseline multi-axis inclinometer.

FIG. 4.2 is an enlarged schematic plan view of the left-side multi-axis inclinometer when the left side broom is in its extended position.

FIG. 4.3 is an enlarged schematic plan view of the right-side multi-axis inclinometer when the right side broom is in its extended position.

FIG. 4.4 is a schematic plan view of the left side broom having a pitch axis 50-50 and an approximately orthogonal tilt axis 48-48, wherein the side broom is independently rotatable about the tilt axis 48-48 to create the "waning moon" strike pattern against a curb line as shown.

FIG. 4.5 is a schematic plan view of the right side broom having a pitch axis 50-50 and an approximately orthogonal tilt axis 48-48, wherein the side broom is independently rotatable about the tilt axis 48-48 to create the "waning moon" strike pattern shown.

FIG. 4.6 is a schematic plan view of a representative side broom including a pitch axis 50-50 and an approximately orthogonal tilt axis 48-48, wherein the side broom is independently rotatable about the tilt axis 48-48 and the pitch axis 50-50 to create the "waning moon" strike pattern shown.

FIG. 5.1 is a schematic plan view showing a left side broom and a right side broom, each at a spaced apart deployment angle of about 40°.

FIG. 5.2 is a schematic plan view showing the two side brooms of FIG. 5.1, each at a deployment angle of approximately −10°, and respective side views showing the pitch and/or tilt of each broom.

FIG. 5.3 is a schematic plan view showing the left and right side brooms of FIG. 5.1, each at a deployment angle of approximately 0° and spaced apart by a selected distance "D," and respective side views showing the pitch and/or tilt of each broom.

FIG. 5.4 is a schematic plan view showing the left and right side brooms of FIG. 5.1 in their travel positions, in which each side broom is raised above the roadway surface and spaced apart by an arbitrary distance "D," and respective side views showing the pitch and/or tilt of each broom, if any.

FIG. 5.5 schematically illustrates how the "waning moon" strike pattern is formed for the left side broom by a selected angular rotation about the tilt axis to force the bristle ends into the pavement for an increase in sweeping aggressiveness at the curb line.

FIG. 5.6 schematically illustrates how the "waning moon" strike pattern is formed for the right side broom by a selected angular rotation about the tilt axis to force the bristle ends in area of the waning moon pattern into the pavement for an increase in sweeping aggressiveness at the curb line.

FIG. 5.7 schematically illustrates how the "waning moon" strike pattern in a generally forward-facing direction is formed for a side broom by a selected angular rotation about the tilt axis and the pitch axis to force the bristle ends in an area of the waning moon pattern into the pavement for an increase in sweeping aggressiveness.

FIG. 6 is an exemplary flow chart for deploying a single side broom to a selected angle and including the creation of a strike pattern on a selected position about the periphery of the side broom.

FIG. 7 is an exemplary look-up table for assigning positional values to various actuators in 5° increments.

FIG. 8 is a detailed rear elevational view of a deployment angle sensor, control rod, receiving plate, and swing arm for a side broom.

FIG. 9 is a detailed top view of a portion of a side broom and the deployment angle sensor, control rod, receiving plate, and swing arm of FIG. 8.

FIG. 10 is a top view of an exemplary side broom showing the broom adjustment actuators.

FIG. 11 is a perspective view of an exemplary side broom showing the broom adjustment actuators.

FIGS. 17 and 17.1 illustrate vehicle operator control knobs which are rotatable to change the position of the "strike" pattern, with the "strike" pattern shown at the 12 o'clock position in FIG. 17.1 for both side brooms.

FIGS. 18 and 18.1 illustrate vehicle operator control knobs which are rotatable to change the position of the "strike" pattern, with the "strike" pattern shown at the 11 o'clock position for the left side broom and at the 1 o'clock position for the right side broom.

FIGS. 19 and 19.1 illustrate vehicle operator control knobs which are rotatable to change the position of the "strike" pattern, with the "strike" pattern shown at the 10 o'clock position for the left side broom and the 2 o'clock position for the right side broom.

FIGS. 20 and 20.1 illustrate vehicle operator control knobs which are rotatable to change the position of the "strike" pattern, with the "strike" pattern shown at the 9 o'clock position for the left side broom and the 3 o'clock position for the right side broom.

DETAILED DESCRIPTION

Figure 12:
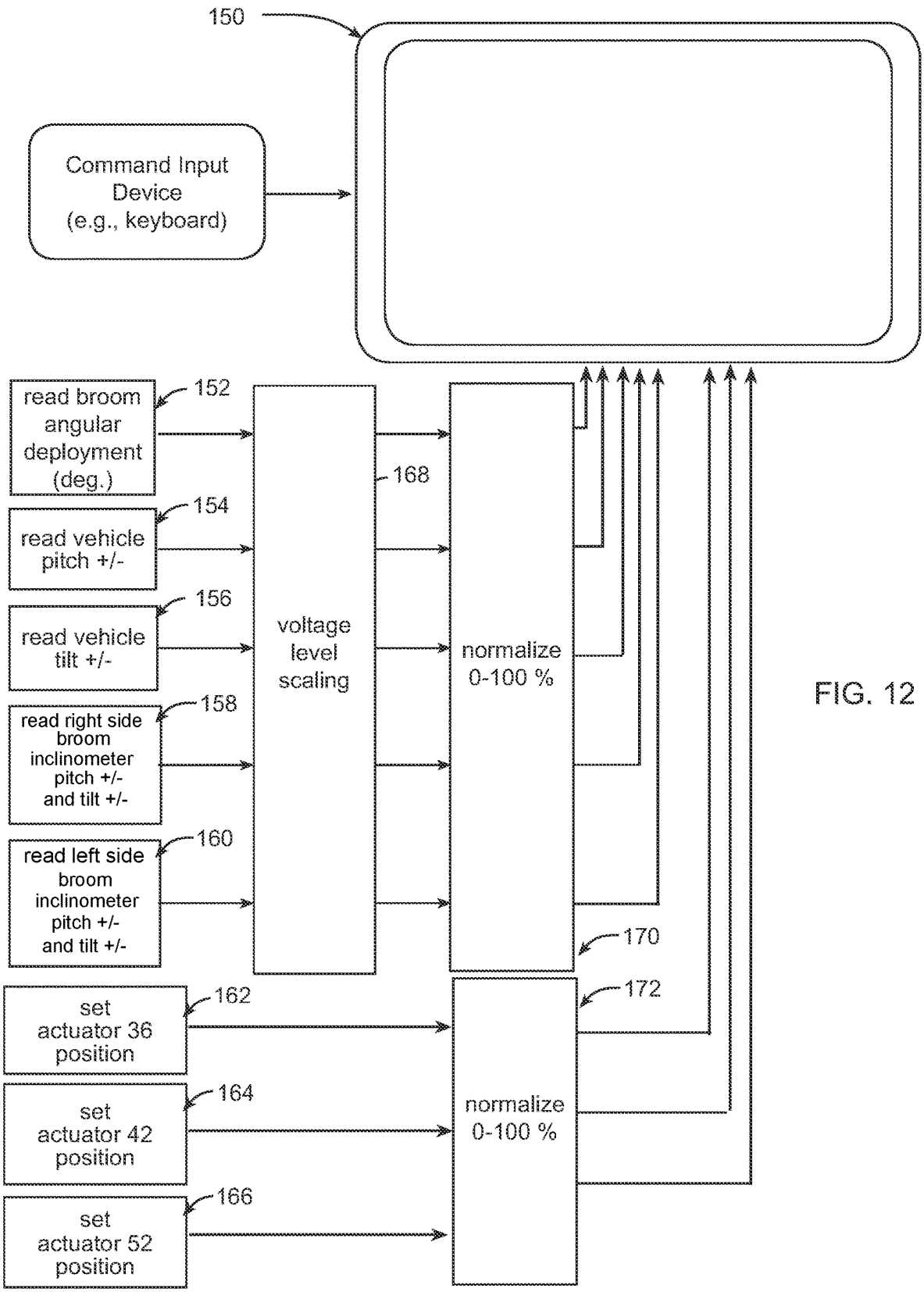
FIG. 12 is a schematic diagram of a display/input screen showing a number of angular sensor devices having a voltage output provided to a voltage level scaling device and which are thereafter converted by normalizing to 0-100% values.

The disclosure of U.S. Pat. No. 10,711,416 issued Jul. 14, 2020, to Glubrecht et. al. (hereinafter the '416 patent) and entitled "Roadway Sweeper With Multiple Sweeping Modes" in common ownership herewith is incorporated herein by reference.

FIGS. 1 and 2 represent different aspects of a coordinate system for roadway-constrained sweeper vehicles, and FIG. 3 presents the coordinate system in plan view and in a simplified manner, illustrating vehicle pitch and vehicle tilt. The coordinate system may be used to reference a roadway sweeper vehicle having a front-to-rear longitudinal axis (FIG. 1) about which the vehicle can roll clockwise or counterclockwise, in part, consequent to the "tilt" of the underlying roadway (FIG. 2). As is known, roadways are often contoured to have a mid-roadway crown that declines on the opposite sides of the crown to gutter areas and curbs.

The side view of a sweeper vehicle in FIG. 1 and the rear view of FIG. 2 depict a pitch axis coaxial with the rear axle of the vehicle (extending into the page in FIG. 1). The front-to-back longitudinal axis (dotted line in FIG. 1) is shown parallel to the roadway. As can be appreciated, other pitch axis placements may be suitable. In this example, the pitch axis is coincident with the rear axle as the sweeper vehicle travels in its forward direction of travel. In those cases where the front wheels of the vehicle encounter declinations and inclinations in the roadway, the sweeper vehicle will pitch down or pitch up about the pitch axis as represented by the double arrowhead in FIG. 1.

The side broom shown in FIG. 1 is tilted (e.g., at an angle of between about ~1° 8° or so) in such a way that the forward-facing bristles form a "strike" pattern or strike zone at the forward facing periphery of the side broom. In FIG. 1, the forward tilt angle has been exaggerated for the purpose of illustration. A "strike" pattern SP (also referred to as a contact patch) is an area about the periphery of a side broom in which the bristles of the broom are intentionally pressed downward into engagement with the roadway to provide a more aggressive sweeping action. In practice and as shown below (e.g., in FIG. 5.1), the "strike" pattern resembles a waxing moon or a waning moon pattern. While, in theory, a strike pattern can extend 180° about the periphery of a side broom, in practice, the most effective portion of the strike pattern typically extends about 120°-160° or so about the periphery of the side broom.

FIG. 3 is akin to a plan view diagram showing various axes of interest for a sweeper vehicle. FIG. 4 illustrates a plan view of a sweeper vehicle with its side brooms shown in fully extended positions (often about 40° or so, as shown in FIG. 5.1, for example), with the left side broom shown positioned at the intersection of the roadway and a curb line to effect gutter cleaning.

As represented in schematic fashion, FIGS. 4.4-4.6 illustrate a side broom having approximately orthogonal axes including a "pitch" axis 50-50 and a "tilt" axis 48-48 with the solid-line strike pattern representing a strike pattern well suited for sweeping and a dotted-line strike pattern representing a less than optimum strike pattern. FIG. 5.4 illustrates side brooms in a "stowed" position (out of contact with the roadway surface) beneath the sweeper vehicle for travel, and FIGS. 5.1-5.3 illustrate side brooms in various lowered positions for sweeping the roadway. As shown in FIG. 5.1, the side brooms are extended from their travel position (FIG. 5.4) to an angle of about 40° or so from vehicle longitudinal axis; as can be appreciated, other extension angles are suitable depending upon manufacturer preference.

As shown in FIG. 4 and FIG. 4.1, a "baseline" pair of orthogonally aligned inclinometers, 100BL, or a multi-axis inclinometer, may be mounted on the sweeper vehicle with one inclinometer axis B-B aligned with the longitudinal axis of the vehicle and another inclinometer axis mounted orthogonal thereto along axis A-A. As shown in FIG. 4 and FIGS. 4.2 and 4.3, an orthogonal inclinometer pair or multi-axis inclinometer are also mounted atop each side broom to measure inclination in two orthogonal axes A-A and B-B.

The two axes of inclinometer(s) 100BL positioned, for example, in or near the operator/passenger cabin may provide information as to the vehicle tilt about the front-to-back longitudinal axis and the vehicle pitch about the vehicle pitch axis. Each such axis about which an inclinometer measures angulation is sometimes referred to herein as a sensitive axis. As shown in FIGS. 4.2 and 4.3, each side broom includes a respective multi-axis inclinometer (or inclinometer pair) designated as 100LS (left side) and 100RS (right side). The baseline inclinometer 100BL provides baseline or reference data for comparison with the often varying data provided by the side broom inclinometers. The side brooms are moved between a fully extended position (FIGS. 4 and 5.1) and a stowed position (FIG. 5.4) in which the side brooms are raised above and out of contact with the roadway surface for travel.

The baseline reference inclinometer 100BL is shown in an exposed unprotected position for reasons of explication. In practice, the baseline reference inclinometer 100BL is mounted in a protected area of the sweeper vehicle. For example, the baseline reference inclinometer 100BL may be mounted within the cabin of the vehicle or elsewhere in a weather-protected position. Ideally, the baseline reference inclinometer may be affixed, directly or indirectly, to the vehicle chassis in a protected position to provide reasonably stable data therefrom.

A suitable multi-axis inclinometer for both the baseline reference inclinometer and the side broom inclinometers is available from Trombetta Corp., Milwaukee, WI 53224, under the PN 99-0680 designation, which inclinometers adhere to the SAE J1939 standard.

Each side broom may be mounted to the undercarriage of the sweeper vehicle by a pivotable swing arm 128, which, in turn, is moved by a bidirectional actuator (e.g., a pneumatic or hydraulic cylinder, or a leadscrew powered by a bidirectional electric motor). One end of each swing arm 128 is connected, directly or indirectly, to the undercarriage and includes a swing arm angular detection device 90 (e.g., deployment angle sensors 90L and 90R shown in FIG. 5.1) (sometimes referred to herein as an angular deployment sensor) to determine the angle of deployment for each side broom. In FIG. 5.1, each broom is shown having a 40° deployment angle from a 0° center axis. As can be appreciated, various manufacturers may select other side broom deployment angles. The left side broom is shown with a waning moon (or waxing moon) "strike" pattern at approximately the 11 o' clock position. The right side broom is shown with a waning moon (or waxing moon) "strike" pattern at approximately the 1 o'clock position. As explained in more detail below, each strike pattern is created by angular rotations of the respective broom about a first axis (e.g., pitch axis 50-50) and/or a second axis (e.g., tilt axis 48-48) to press brush bristle ends into the underlying roadway to increase sweeping efficiency.

FIG. 5.1 presents a left side sweeping broom and a right side sweeping broom in their extended positions, e.g., at about 40° from the 0° reference line. The left side sweeping broom 100LS is under the control of an actuator 36-LS and can pivot from the 0° reference line to about 40° from the left side of the vehicle. In a similar manner, the right side sweeping broom 100RS is under the control of an actuator 36-RS and can pivot from the 0° reference line to about 40° from the right side of the vehicle. As can be appreciated, different manufacturers have different minimum and maximum extension angles for their side brooms. In FIG. 5.2, the left side broom is shown at a −10° position and, similarly, the right side broom is likewise shown at a −10° position. In general, it is usually best that the bristles from each broom do not touch one another. The side view of the left side broom in FIG. 5.2 illustrates that the side broom has been tilted at a selected angle (usually between about 1° and about 8°, for example, although any suitable angle may be used) to provide the strike pattern shown. In a similar manner, the right side broom has likewise been shown in side view and similarly tilted to show the right side strike pattern. In FIG. 5.3, the left and right side brooms are shown deployed in their 0° positions and spaced apart from one another by a distance "D" (usually about 4 to 8 inches, for example, but any suitable distance could be employed). As shown in the left and right side view images of the respective side brooms, the side brooms are tilted in the forward-facing direction to create the strike pattern shown. In FIG. 5.4, the left and right side brooms are shown in their 0° stowed positions and spaced apart from one another by a distance "D" (usually about 4 to 8 inches, for example, but any suitable distance could be employed). As shown on the left and on the right of FIG. 5.4, both side brooms are raised above and out of contact with the roadway surface to define a roadway or highway travel configuration.

FIGS. 5.5 to 5.7 represent the side brooms each with a pitch axis 50-50 and a tilt axis 48-48 about which the broom can be rotated to produce a desired strike pattern. In FIG. 5.5, the side broom is rotated in a first direction (e.g., counterclockwise when viewed from the left side of the vehicle) about the tilt axis 48-48 to press the broom bristles into the roadway to provide the strike pattern area 1 as shown, with substantially no rotation about the pitch axis 50-50. In general, the strike pattern area 1 shown in FIG. 5.5 is considered optimal or near-optimal for sweeping against a left side curb line. In contrast, rotating the side broom of FIG. 5.5 in a second direction (e.g., clockwise when viewed from the left side of the vehicle) about the tilt axis 48-48 would provide a strike pattern area 2 as shown. In general, that strike pattern area 2 may have little value for sweeping against a left side or right side curb line but may be useful in other applications.

In FIG. 5.6, the side broom is rotated a small amount about the tilt axis 48-48 in a first direction to provide the strike pattern area 1 shown for sweeping against a right side curb line as shown, with substantially no rotation about the pitch axis 50-50. In general, the strike pattern area 1 shown in FIG. 5.6 is considered optimal or near-optimal for sweeping against a right side curb line. The side broom may be rotated about the tilt axis 48-48 in a second direction to produce the strike pattern area 2 as shown, again with substantially no rotation about the pitch axis 50-50.

In FIG. 5.7, the side broom is rotated a small amount about both the tilt axis 48-48 and the pitch axis 50-50 to provide the forward facing strike pattern area shown for sweeping in a forward facing direction in line with the direction of travel of the sweeping vehicle.

For each broom, it will be understood that any combination of rotations about the tilt axis 48-48 and/or the pitch axis 50-50 (each of which may be defined in any suitable location and orientation) may be employed to produce a desired strike pattern that is oriented in any desired orientation on the roadway with respect to the vehicle or with respect to an object external to the vehicle, such as a curb line, for example. In some embodiments, the brooms and actuators described herein may operate under the supervision of an appropriately programmed controller that can take the form of one or more stored-program controlled (e.g., firmware and/or software) microprocessors or microcomputers (as well as general-purpose or special-purpose computers or processors, including RISC processors), application-specific integrated-circuits (ASIC), programmable logic arrays (PLA), discrete logic or analog circuits, with related non-volatile and volatile memory, and/or combinations thereof. For example, in some embodiments, a commercially available programmable mobile controller from IFM Efector, Inc., Malven PA under the part designation CR0234 and an associated keypress/display under part designation CR1081 may be used. Of course, any suitable controller may be used.

FIG. 6 presents a flow chart for carrying out a request to reposition a side broom. After the process is started, a query is presented at step 110 as whether or not a new request has been made for a new broom angle deployment. If NO, the processor recycles back to the start point. If YES, the requested deployment angle for the side room is input at execution step 112. Typically, the requested deployment angle can be anywhere between about −10° and about +40° but any suitable range of deployment angle may be used. Thereafter, at step 114, a reference is made to a lookup table to lookup new positions for the broom pitch axis and tilt axis actuators (discussed in more detail below) to create the desired peripheral strike pattern. At step 116 and using the lookup table data, the pitch axis and tilt axis actuators may reposition the strike pattern, with sufficient time being provided at step 118 for the redeployment. A query is presented at step 120 as to whether the broom is in the correct position. If yes, the process returns to the start. If no, the process is returned to step 116 so that the broom may be positioned properly.

An exemplary look-up table is shown in FIG. 7, wherein the broom deployment angle is specified in 5° increments. The remaining table cells have not been fill-in as they are dependent on the particular broom structures and axes. In general, it may be preferable to define all axis adjustments as a percentage value of a wider range of movement.

FIGS. 8 and 9 present an angular rotary position sensor 122 shown in rear elevational view (FIG. 8) and top view (FIG. 9) with the sensor portion 122 mounted directly or indirectly to the vehicle undercarriage and connected through a control rod 124 to a receiving plate 126 attached to the swing arm 128. Any pivoting motion by the swing arm 128 actuates the sensor 90, 90L, 90R (see FIGS. 5.1 to 5.4) by moving a magnet therein to generate a signal representative of the angular displacement of the swing arm 128. A suitable rotary position sensor is available from Honeywell Inc., Fort Mill SC 29797 under the RTY part descriptor by which a magnetically biased, Hall-effect integrated circuit (IC) senses rotary movement of the actuator over a predetermined operating range to provide an angular output metric. A multi-axis inclinometer 100 is also provided for measuring the pitch and tilt of the broom.

The system presented herein may include side brooms having controllable actuators that can press a selected peripheral segment of a side broom into a roadway surface being swept to create a desired strike pattern and maintain the directionality of the selected peripheral segment strike pattern as the side broom(s) are moved from one angular position to another position to another.

In some embodiments, the positioning system may utilize an empirically determined lookup table for each side broom angular deployment. By using the deployment angle of a side broom to refer to the lookup table, values may be obtained for each set of side broom actuators to maintain the desired "strike" pattern. The control cycle may be repeated at a desired repetition rate to automatically maintain the "strike" pattern in the desired position regardless of changes in the deployment angle.

The automatic side broom positioning system may use side brooms of the type shown in FIGS. 10 and 11 and designated herein by the reference character 30. In FIGS. 10 and 11, various components have been omitted from the views for the sake of clarity to further the explication thereof. A more detailed presentation of these side brooms is presented in the above incorporated '416 patent.

As best shown in FIG. 10, each side broom 30 includes a circular disk plate 32 to which preformed bristle blocks (not shown) are secured, for example, with threaded fasteners, as is conventional in this art, or in any other suitable manner. A motor 34 (e.g., a hydraulic motor) is attached, directly or indirectly, to the bristle-carrying disk to effect rotation in a preferred direction. A multi-axis inclinometer 100 is provided for measuring the pitch and tilt of broom 30. As shown in FIGS. 10 and 11, a first bidirectional cylinder 36 (e.g., a pneumatic cylinder) includes a piston rod 38 that is movable between an extended position and a retracted position and any desired position therebetween. Piston rod 38 may be connected to swing arm 128 (see, e.g., FIGS. 5.1-5.4) via a connector 40. The bidirectional cylinder 36 is connected at a base end, directly or indirectly, to the undercarriage of the sweeper vehicle. When the piston rod 38 is in its fully retracted position, the side broom 30 is in a first position, and when the piston rod 38 is fully extended, the entire side broom assembly 30 moves to a second operational position. The bidirectional cylinder 36 is typically used to move a side broom between its fully retracted position (often partially or fully beneath the vehicle sweeper chassis) and a fully extended position for sweeping operations; however, any position therebetween is also available.

As best shown in both FIGS. 10 and 11, a second bidirectional cylinder 42 includes an extendable/retractable piston rod 44 connected to a fin 46 that, in turn, is connected to the motor housing. By moving piston rod 44 of the cylinder 42 between its fully retracted position and its fully extended position, the broom 30 rotates about a pitch axis 50-50. When the piston rod 44 is pushed towards its extended position, the side broom 30 rotates about pitch axis 50-50 to create a "strike" pattern in the zone generally extending from A to B. In a similar manner, when the piston rod 44 is pulled toward its retracted position, the side broom rotates about pitch axis 50-50 to create a "strike" pattern in the zone generally extending from C to D. A "strike" pattern (or "contact" patch) is an area of increased sweeping aggressiveness by virtue of the broom 30 being tilted so that the ends of the bristles are pushed into the area being swept to provide an enhanced or more aggressive sweeping or scrubbing effect. As mentioned above, the "strike" pattern may loosely approximate a waxing moon or a waning moon pattern.

As shown in FIGS. 10 and 11, the side broom 30 is also movable about a tilt axis 48-48. In FIG. 11, a bidirectional fluid cylinder 52 includes a retractable/extensible ram 54 connected to an L-shaped crank arm 56. As the ram 54 moves to its extended position, the crank arm 56 rotates counterclockwise to push a cylindrical pin 58 downward to cause the side broom 30 to rotate about tilt axis 48-48 in a first direction. As the ram 54 is retracted, the connected L-shaped crank arm 56 is pulled toward the cylinder body 52 and the pin 58 lifts the motor housing to rotate the broom 30 about the tilt axis 48-48 in a second (opposite) direction. In some embodiments, to achieve such broom rotation about pitch axis 50-50 and tilt axis 48-48, the various operating cylinders and related parts, including sleeve bearings for accepting cylindrical shafts, may be mounted in a spheroidal carrier to provide the necessary degrees-of-freedom, as disclosed in the above incorporated '416 patent, for example. Of course, other suitable arrangements are possible.

The above-described side brooms, in combination with the controlled extension/retraction of the bidirectional actuators 36, 42, and 52 associated with each side broom, provide multiple possible "strike" pattern positions about the periphery thereof. Many "strike" patterns may be well-suited for use in the forward sweeping mode and/or in a left side broom or right side broom curb and gutter sweeping mode. Thus, for example, a "strike" pattern may be the result of a fully or partially extended actuator 42 or 52, or a fully or partially retracted actuator 42 or 52, or a combination thereof. As can be appreciated, other "strike" positions about the periphery of a side boom are possible by control of the actuators 42 and 52 and, if needed, the angular deployment of a side broom via actuators 36.

FIG. 12 illustrates a commercially available programmable mobile controller/touch screen 150 that receives various inputs (including operator keyboard input) for processing and subsequent control of the various actuators described herein. In the preferred embodiment, the controller/touch screen is available from IFM Efector, Inc., Malven Pa. under the part designation CR0234 and an associated keypress/display under part designation CRI081. Other commercially available equivalents may be used.

In FIG. 12, the various devices that provide an output (e.g., angle sensors 152-160) have their respective outputs read and provided to a voltage level/scaling processor 168. Because each of the various sensor devices can have different voltage outputs, it is considered beneficial to scale those voltages to a single standard framework. Thereafter, the scaled voltage values are provided to processor 170, which converts all the scaled values into a 0-100% normalized metric which is then provided to the controller/touch screen 150. Likewise, the actuator positions 162, 164, 166 are provided to processor 172, which converts the actuator position values into a 0-100% normalized metric which is then provided to the controller/touch screen 150. The use of a 0-100% normalized metric beneficially allows deployment or adjustment of devices as a function of a common scale. Of course, no scaling or normalization, or other scaling or normalization schemas, may be used, if desired.

The system described above may operate under the supervision of an appropriately programmed controller that can take the form of one or more stored-program controlled (i.e., firmware and/or software) microprocessors or microcomputers (as well as general purpose computers or special-purpose processors, including RISC processors, application-specific integrated-circuits (ASIC), programmable logic arrays (PLA), discrete logic or analog circuits, with related non-volatile and volatile memory, and/or combinations thereof.

Once the automatic side broom positioning system receives its instructions from the vehicle operator, (i.e., side broom selection, side broom angular deployment, "strike" pattern position, etc.) the system will operate autonomously until further instructions are provided.

Figure 13:
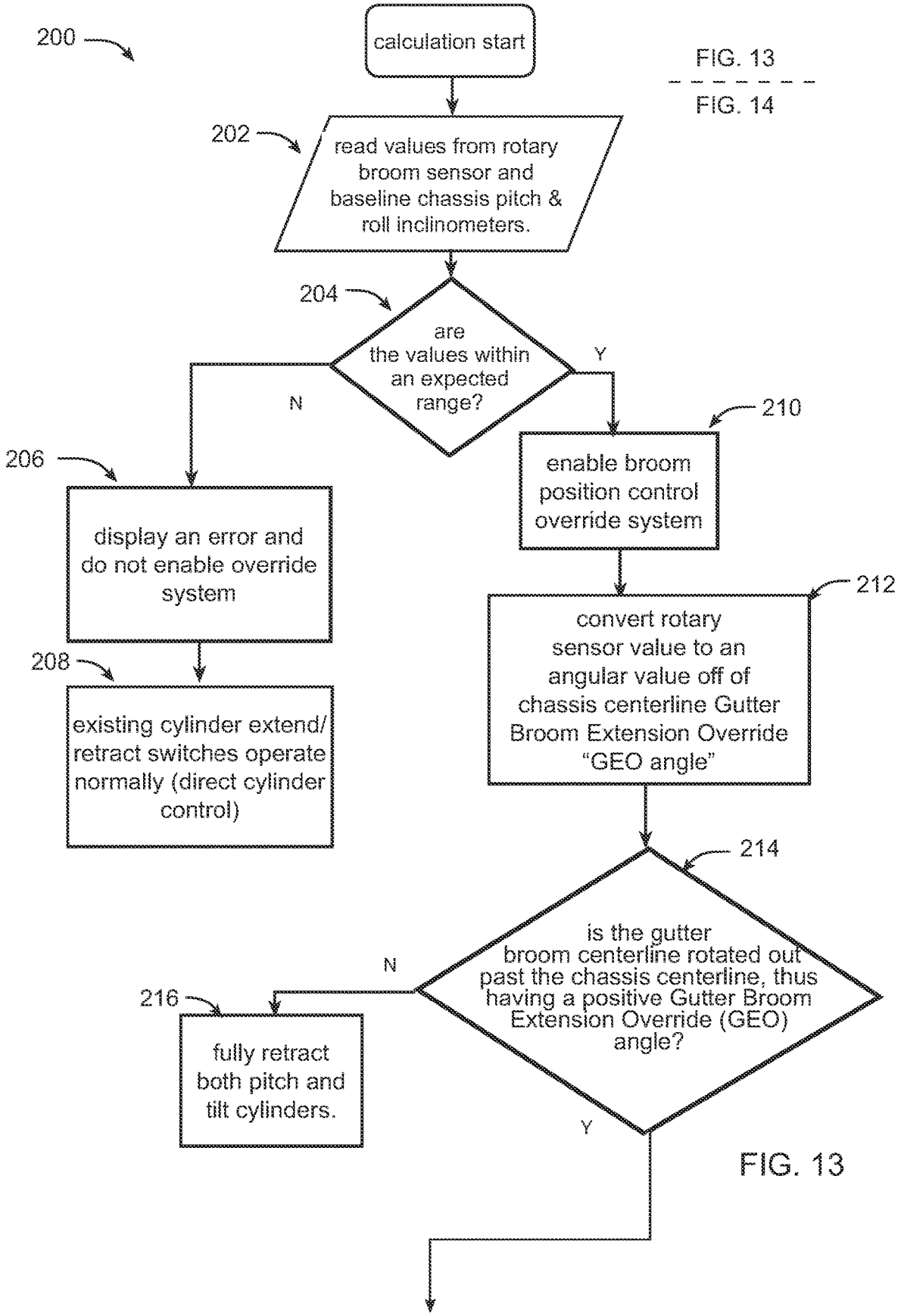
FIGS. 13 and 14 present a process flow diagram for calculating target pitch and roll values for placement into a memory for subsequent use.
Figures 13, 14:
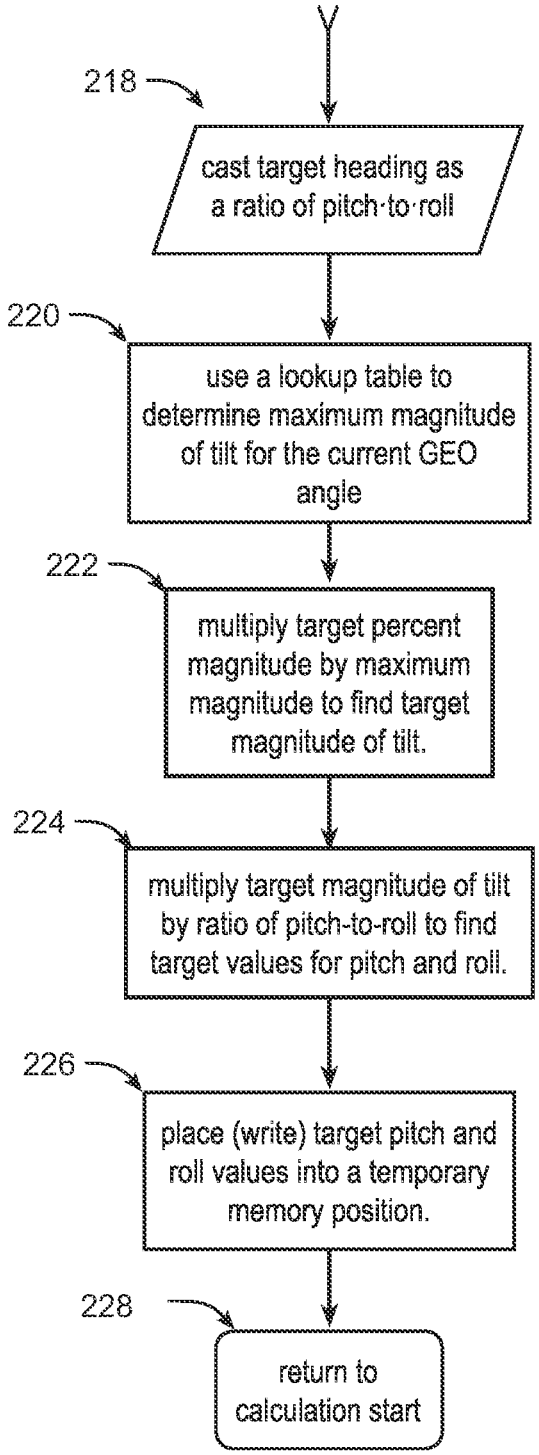

FIGS. 13 and 14 are a flow diagram presenting a sequence 200 for calculating target pitch and roll values for placement into a memory for subsequent use. As shown in FIG. 13, once the calculation process is started, at step 202 the outputs from the rotary broom deployment sensor in the chassis and the pitch and roll output of the baseline reference inclinometer are stored and displayed. At step 204, a query is presented as to whether the values are within an expected range. If the values are outside the expected range, an error message is displayed at step 206, and the system override is not enabled. Thereafter, at step 208, the existing cylinder extension/retraction switches will operate normally and be available to the vehicle operator, i.e., direct control of bidirectional cylinders 36, 42, and 52 is available to the vehicle operator. If the values are within the expected range at step 204, the broom position control override system is enabled at step 210. Thereafter, at step 212, rotary sensor values are converted into an angular value. At step 214, a query is then presented as to whether the gutter broom centerline is rotated out past the chassis centerline. If this condition is not satisfied, the system operates to fully retract both pitch and tilt cylinders at step 216. Conversely, if the criteria for step 214 is met, processing progresses (from FIG. 13 to FIG. 14) where, at step 218, the target heading is processed into a ratio of the pitch-to-roll value. The processing then proceeds to step 220 where a lookup table determines the maximum magnitude of tilt for the current override angle. In general, the lookup table information may be determined empirically. Thereafter, at step 222, the target percent magnitude is multiplied by the maximum magnitude to find the target magnitude of tilt. Thereafter, at step 224, the target magnitude of tilt is multiplied by the ratio of pitch-to-roll to find target values for pitch and roll. Thereafter, at step 226, the target pitch and roll values are written to a temporary memory position for subsequent recall, with the process sequence returning to the start calculation step for another processing cycle as shown at step 228.

Figure 15:
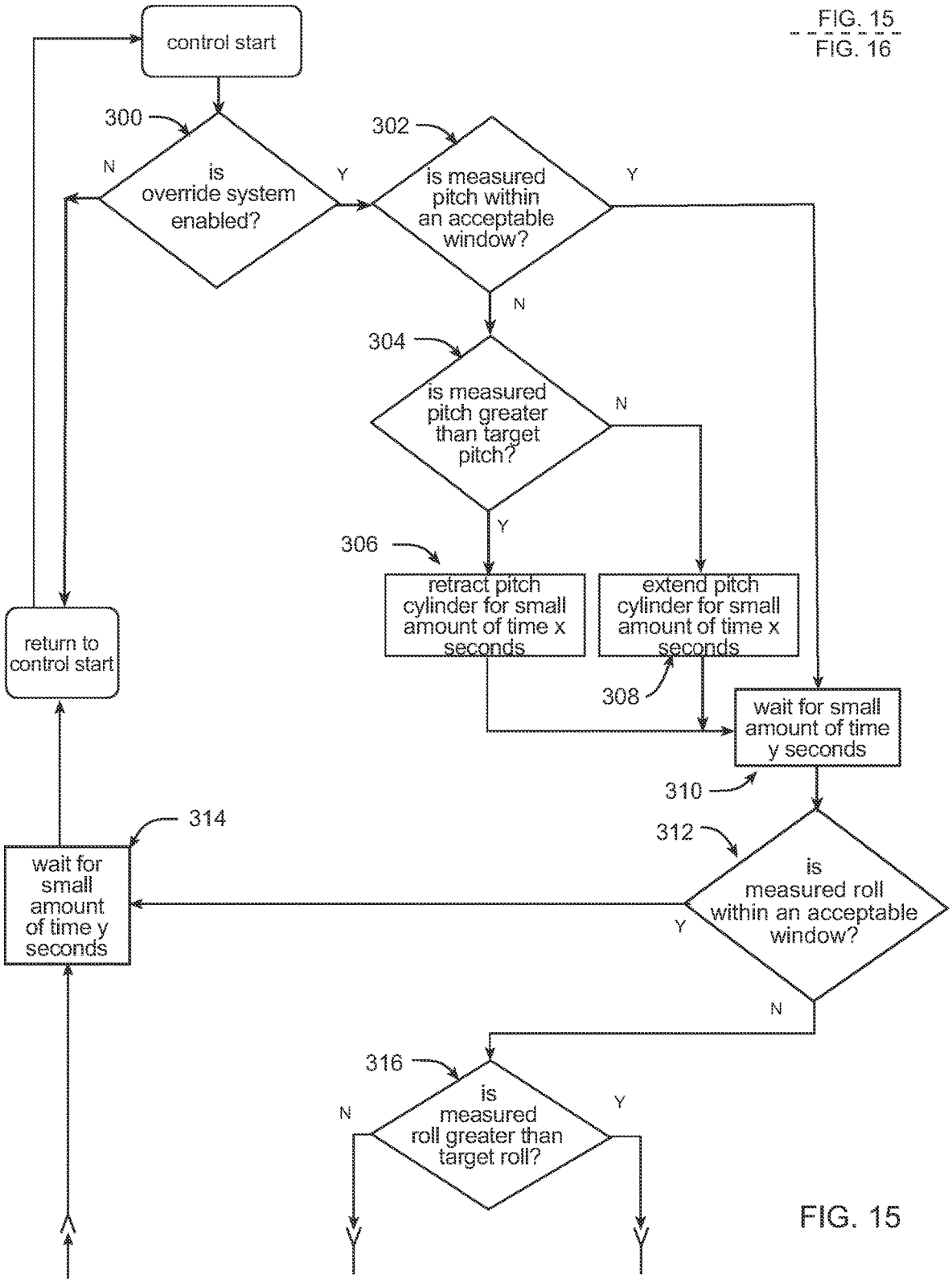
FIGS. 15 and 16 present a process flow diagram for using a manual override system.
Figures 15, 16:
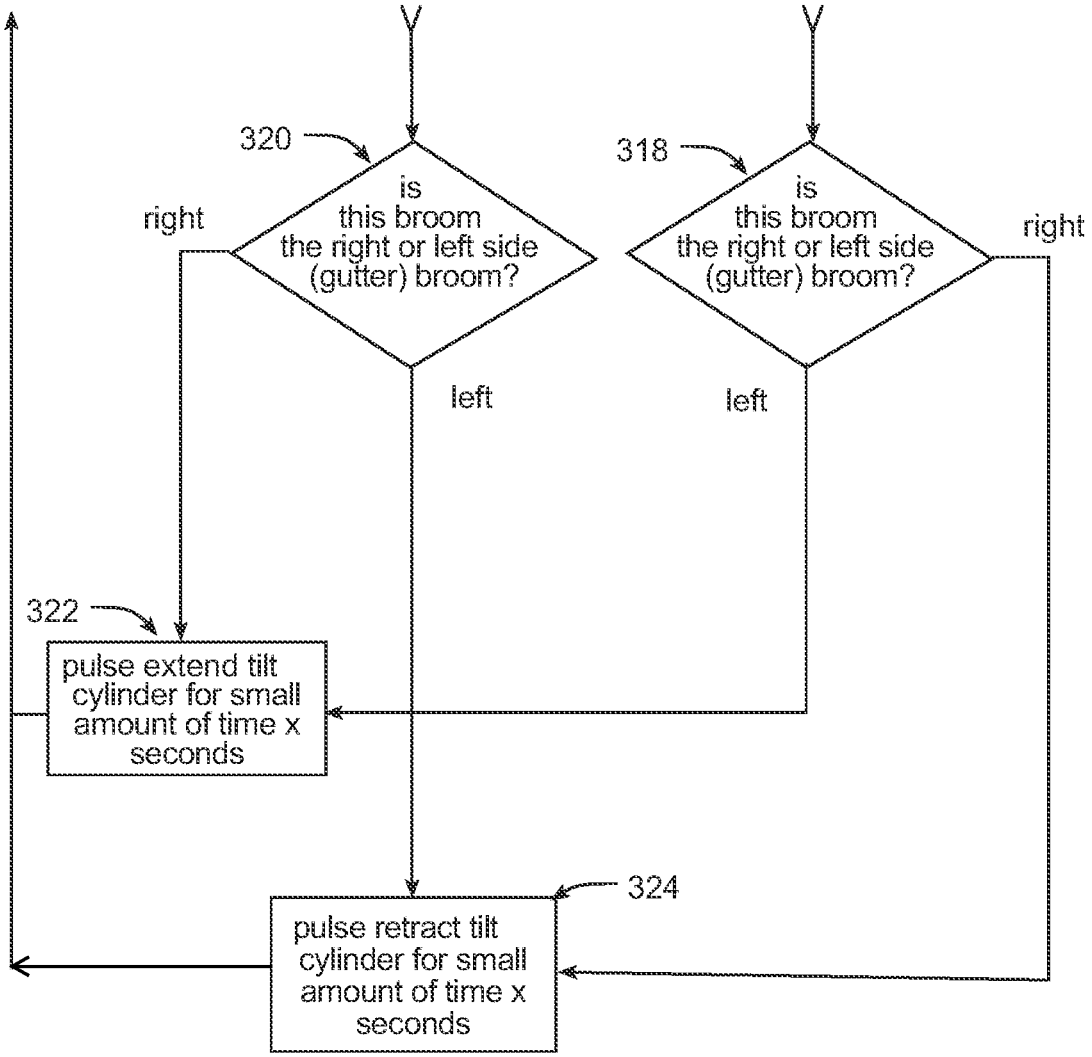

FIGS. 15 and 16 present a flow chart related to the use of the override arrangement. In FIG. 15, once the sequence is initiated, at 300 a query is presented as to whether the override system is enabled. If the override system is not enabled, the process flow returns to the start position and continues to loop until such time as an override system enablement is found. Once it is determined that the override system has been enabled, at 302 a query is presented as to whether the measured pitch is within an acceptable window. If the measured pitch is not within an acceptable window, at 304 a query is presented as to whether the measured pitch is greater than the target pitch. If the query at 304 is satisfied, at 306 a command is issued to retract the pitch cylinder for a small amount of time, such as X seconds. If the measured pitch is not greater than the target pitch at 304, at 308 a command is executed to extend the pitch cylinder for a small amount of time, such as X seconds. The flow from block 306 or 308, as the case may be, is then presented to block 310 with a command to wait for a small amount of time such as y seconds. Thereafter, in block 312, a query is presented as to whether the measured roll is within an acceptable window. If the answer at 312 is yes, then at 314 a request is presented to wait for small amount time, such as y seconds, and then return to control start. If the answer at 312 is no, then at 316 a query is presented as to whether the measured roll is greater than the target roll. If the answer at 316 is yes, then (moving from FIG. 15 to FIG. 16) at 318 a query is presented as to whether the broom is the right side broom or the left side broom. If it is the left side broom coming out of query 318, at 322 a pulse command is issued to extend the pitch cylinder for a small amount of time, such as x seconds. If it is the right side broom coming out of query 318, at 324 a pulse command is issued to retract the pitch cylinder for a small amount of time, such as x seconds. Back to FIG. 15, if the answer at 316 is no, then (moving from FIG. 15 to FIG. 16) at 320 a query is presented as to whether the broom is the right side broom or the left side broom. If it is the left side broom coming out of query 320, at 324 a pulse command is issued to retract the pitch cylinder for a small amount of time, such as x seconds. If it is the right side broom coming out of query 320, at 322 a pulse command is issued to extend the pitch cylinder for a small amount of time, such as x seconds. After step 322 or 324, the process returns back to step 314 in FIG. 15 and ultimately back to the control start.

FIGS. 17 through 20.1 illustrate a series of "screen shots" representing options available to the vehicle operator when the system is in override mode. Rotary knobs 400 (for the left side broom) and 402 (for the right side broom) are available to the vehicle operator to control placement of a "strike" pattern for each of the side brooms. In FIG. 17, the operator has rotated the knobs 400 and 402 to select a "strike" pattern at the forward-facing 12 o'clock position for each side broom, and the electronic display (which may be part of the controller system, in some embodiments) beneath knobs 400 and 402 reflects those strike pattern positions as shown in FIG. 17.1. In that configuration, the forward-facing 12 o'clock "strike" pattern positions will be maintained continuously while sweeping until changed via the knobs 400 and 402, respectively.

FIG. 18 represents the circumstance where the vehicle operator has rotated the knobs 400 and 402 causing the "strike" pattern to rotate about 30° to the 11 o'clock position and the 1 o'clock position, respectively. The electronic display beneath knobs 400 and 402 reflects those strike pattern positions as shown in FIG. 18.1. In a similar manner and as shown in FIG. 19, continued rotation of the knobs 400 and 402 will cause the "strike" pattern to move to the 10 o'clock position and the 2 o'clock position, respectively, with the corresponding strike patterns shown on the electronic display as illustrated in FIG. 19.1. Lastly, further rotation of the knobs 400 and 402 will cause the strike patterns to move to the 9 o'clock position and the 3 o'clock position, respectively, as illustrated in FIGS. 20 and 20.1. In each of these operator-selectable positions for the "strike" pattern, the selected strike pattern will remain in place even as the brooms are pivoted to different positions via the swing arms 128 by virtue of the brooms' angular deployment (swing angle, pitch, and tilt) and the vehicle angular position (pitch and tilt) being available to the controller 150 as described herein.

As will be apparent to those skilled in the art, various changes and modifications may be made to the illustrated embodiments without departing from the spirit and scope of the invention as determined by the appended claims and their legal equivalents. Among other things, any feature described for one embodiment may be used in any other embodiment, and any feature described herein may be used independently or in combination with other features. For example, the electronic processing herein discloses a mix of analog devices and digital devices; both processing types are equally suitable, either alone or in combination. Also, unless the context indicates otherwise, it should be understood that when a component is described herein as being mounted to another component, such mounting may be direct with no intermediate components or indirect with one or more intermediate components. Although the side brooms are generally described herein as having a substantially round shape in plan or bottom view, such brooms may have any suitable shape (e.g., oval, polygonal, irregular, or a combination thereof). Similarly, although the side brooms are generally described herein as being configured for rotation about a substantially vertical or somewhat tilted axis, in some embodiments, one or more of such brooms may be configured for another type of motion, e.g., vibratory, oscillatory, reciprocating, random orbit, or a combination thereof, either in lieu of or in addition to rotation as described herein. Likewise, although the systems described herein have been illustrated in the context of a vacuum sweeper, the features described herein may be used in other types of sweepers as well. The scope of the invention is defined by the attached claims and other claims that may be drawn to this invention, considering the doctrine of equivalents, and is not limited to the specific examples described herein.

What is claimed is:

1. A system for automatic positioning of a strike pattern of one or more side brooms mounted to a sweeper vehicle on a roadway, the sweeper vehicle having a chassis and a longitudinal axis, each side broom movable between a fully extended position and a stowed position, comprising:

a first baseline inclinometer attached, directly or indirectly, to the vehicle chassis and having a sensitive axis aligned along a front-to-back axis of the sweeper vehicle for measuring vehicle tilt about the front-to-back axis;

a second baseline inclinometer attached, directly or indirectly, to the vehicle chassis and having a sensitive axis aligned along a side-to-side axis of the sweeper vehicle for measuring vehicle pitch about the side-to-side axis;

at least one side broom mounted to the sweeper vehicle and comprising bristles;

at least one actuator configured for moving the at least one side broom between an extended position and a stowed position;

an angular deployment sensor configured for sensing an angular deployment position of the at least one side broom relative to the longitudinal axis of the sweeper vehicle;

a broom tilt inclinometer attached to the at least one side broom for measuring a broom tilt angle about a broom tilt axis for the at least one side broom;

a broom pitch inclinometer attached to the at least one side broom for measuring a broom pitch angle about a broom pitch axis for the at least one side broom;

a broom tilt actuator configured for adjusting the broom tilt angle;

a broom pitch actuator configured for adjusting the broom pitch angle; and a controller in communication with the inclinometers and the actuators, the controller configured for positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

2. The system of claim 1 wherein the controller is configured to maintain the selected strike pattern regardless of the angular deployment position.

3. The system of claim 1 wherein the controller comprises an override mode to enable a vehicle operator to control the strike pattern.

4. The system of claim 1 wherein the first and second baseline inclinometers comprise a multi-axis inclinometer.

5. The system of claim 1 wherein the broom tilt inclinometer and the broom pitch inclinometer comprise a multi-axis inclinometer.

6. The system of claim 1 wherein an orientation of the strike pattern is selectable with respect to the longitudinal axis of the sweeper vehicle.

7. The system of claim 6 further comprising a control knob configured for enabling a vehicle operator to select the orientation of the strike pattern in reference to a clock position, wherein a 12 o'clock position corresponds to a generally forward-facing direction consistent with a direction of travel of the sweeper vehicle.

8. The system of claim 1 wherein the at least one side broom comprises a left side broom and a right side broom, and wherein the strike patterns of the left side broom and the right side broom are independently selectable.

9. The system of claim 8 wherein the strike patterns of the left side broom and the right side broom are selectable in reference to a left curb and a right curb, respectively.

10. A method of controlling a strike pattern of at least one side broom mounted to a sweeper vehicle on a roadway, the sweeper vehicle having a chassis and a longitudinal axis, each side broom comprising bristles and movable between a fully extended position and a stowed position, the method comprising:

measuring a vehicle tilt about a front-to-back axis of the sweeper vehicle;

measuring a vehicle pitch about a side-to-side axis of the sweeper vehicle;

sensing an angular deployment position of the at least one side broom relative to the longitudinal axis of the sweeper vehicle;

measuring a broom tilt angle about a broom tilt axis for the at least one side broom;

measuring a broom pitch angle about a broom pitch axis for the at least one side broom; and positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

11. The method of claim 10 wherein the vehicle tilt, the vehicle pitch, the broom tilt angle, and the broom pitch angle are measured using a plurality of inclinometers.

12. The method of claim 10 further comprising using a lookup table to determine settings for a pitch axis actuator and a tilt axis actuator for the at least one side broom.

13. The method of claim 12 wherein the settings for the pitch axis actuator and the tilt axis actuator are determined based on the angular deployment position.

14. The method of claim 10 further comprising maintaining the selected strike pattern as the angular deployment position changes.

15. The method of claim 10 wherein the positioning is carried out by a controller comprising an override mode that enables a vehicle operator to control the strike pattern.

16. A sweeper vehicle having a chassis and a longitudinal axis, the sweeper vehicle comprising:

a first baseline inclinometer attached, directly or indirectly, to the vehicle chassis and having a sensitive axis aligned along a front-to-back axis of the sweeper vehicle for measuring vehicle tilt about the front-to-back axis;

a second baseline inclinometer attached, directly or indirectly, to the vehicle chassis and having a sensitive axis aligned along a side-to-side axis of the sweeper vehicle for measuring vehicle pitch about the side-to-side axis;

at least one side broom mounted to the sweeper vehicle and comprising bristles;

at least one actuator configured for moving the at least one side broom between an extended position and a stowed position;

an angular deployment sensor configured for sensing an angular deployment position of the at least one side broom relative to the longitudinal axis of the sweeper vehicle;

a broom tilt inclinometer attached to the at least one side broom for measuring a broom tilt angle about a broom tilt axis for the at least one side broom;

a broom pitch inclinometer attached to the at least one side broom for measuring a broom pitch angle about a broom pitch axis for the at least one side broom;

a broom tilt actuator configured for adjusting the broom tilt angle;

a broom pitch actuator configured for adjusting the broom pitch angle; and a controller in communication with the inclinometers and the actuators, the controller configured for positioning the at least one side broom in a sweeping position wherein the bristles are engaged with the roadway and form a selected strike pattern based on the vehicle tilt, the vehicle pitch, the angular deployment position, the broom tilt angle, and the broom pitch angle.

17. The sweeper vehicle of claim 16 wherein the controller is configured to maintain the selected strike pattern as the angular deployment position changes.

18. The sweeper vehicle of claim 16 wherein the controller comprises an override mode to enable a vehicle operator to control the strike pattern.

19. The sweeper vehicle of claim 18 further comprising a control knob configured for enabling a vehicle operator to select an orientation of the strike pattern in reference to a clock position, wherein a 12 o'clock position corresponds to a generally forward-facing direction consistent with a direction of travel of the sweeper vehicle.

20. The sweeper vehicle of claim 16 wherein the at least one side broom comprises a left side broom and a right side broom, and wherein the strike patterns of the left side broom and the right side broom are independently selectable.

* * * * *